United States Patent [19]

Gauronski et al.

[11] 4,327,993

[45] May 4, 1982

[54] METHOD AND APPARATUS FOR PERFORMING JOB RECOVERY IN A REPRODUCTION MACHINE

[75] Inventors: John F. Gauronski, Rochester; Gary M. McGibbon, Ontario, both of N.Y.

[73] Assignee: Xerox Corporation, Stamford, Conn.

[21] Appl. No.: 89,340

[22] Filed: Oct. 30, 1979 (Under 37 CFR 1.47)

[51] Int. Cl.[3] ..... G03G 15/00; G03G 13/22

[52] U.S. Cl. ..... 355/14 SH; 355/3 SH; 355/77

[58] Field of Search ..... 355/3 R, 3 SH, 14 R, 355/14 SH, 77, 133

[56] References Cited

U.S. PATENT DOCUMENTS 4,190,354 2/1980 Smith et al. ..... 355 14 SH X/

*Primary Examiner*—Fred L. Braun

*Attorney, Agent, or Firm*—Ronald F. Chapuran

[57] ABSTRACT

Various operating modes of the reproduction machine require the use of an automatic document handler, a finisher station, and a dedicated duplex tray. Various machine malfunctions require different degrees of operator intervention and job recovery. Depending upon the clearance procedures required, the machine will automatically make up for lost or damaged copy sheets with a minimum amount of operator intervention, loss of copy sheets and efficient use of the machine operating components. In particular, for automatic duplex operation, the dedicated duplex tray is primed with certain copies of the documents to be copied in a predetermined sequence. Job recovery is an automatic procedure to reprime or add to the copy sheets already in the dedicated duplex tray to make up for lost or damaged copies in the set without necessarily having to reject a whole set having partial copies in process or copies destroyed in the operator intervention activity. Job recovery for other machine elements is also included.

3 Claims, 18 Drawing Figures

METHOD AND APPARATUS FOR PERFORMING JOB RECOVERY IN A REPRODUCTION MACHINE

This invention relates to a reproduction machine, in particular to a reproduction machine having automatic job recovery.

In using reproduction machines, there are various types of system shut downs or malfunctions that can occur in the various system operating modes. Operator involvement in correcting for the malfunction can often be extensive particularly in machines with various accessories such as sorters, collaters, finishers and document handlers. The problem of correcting the malfunction and maintaining the integrity of the run in process can be a significant problem. For example, jammed copies are often damaged and require removal before the machine can be restarted. However, the loss of these partially processed copies interferes with the normal sequence of the reproduction run and it is necessary to restart the reproduction run or to make up for the removed copies to continue the process at the point of interruption.

There are various types of recovery procedures, both automatic and manual, in the prior art for recovery for various types of system shutdowns. For example, U.S. Pat. Nos. 4,054,380; 3,944,794; and 3,819,266 are representative of patents showing general copier jams and recovery control. U.S. Pat. No. 3,944,794, assigned to the same assignee as the present invention, teaches a job recovery technique in a reproduction machine that is a high volume machine with a sorter and document handler, but does not have the provision for producing duplex copies. U.S. Pat. No. 4,130,354, assigned to the same assignee as the present invention, teaches a job recovery technique in a reproduction machine having a duplex capability. This job recovery technique is used in a system that does not have a more fully automatic duplexing capability, in particular, having a dedicated duplex buffer tray. As operations, such as duplexing become more automatic, of course, the job recovery requirements are often much more sophisticated.

It would therefore be desirable, to provide a sophisticated, efficient automatic job recovery system that minimizes operator intervention. In particular, it would be desirable to provide a malfunction detection and job recovery system involving progressively decreasing clearance procedures by the operator and progressively increasing automatic job recovery procedures within the machine itself to recover from a wide variety of malfunction occurrances in a reproduction machine operating in various modes including an automatic duplex mode with a dedicated duplex tray.

It is therefore an object of the present invention to provide a new and improved automatic job recovery system in a reproduction machine operating in a variety of modes including a fully automatic duplex mode with a dedicated duplex tray. Further objects and advantages of the present invention will become apparent as the following description proceeds and the features characterizing the invention will be pointed out with particularity and the claims annexed to and forming a part of this specification.

Briefly, the present invention is concerned with job recovery in a reproduction machine having a variety of modes of operation including automatic duplexing with a dedicated duplex tray. Various operating modes of the reproduction machine require the use of an automatic document handler, a finisher station, and a dedicated duplex tray. Various machine malfunctions require operator intervention and corrective action within the document handler, the machine processor and the finisher station. Depending upon the clearance procedures required, the machine will automatically make up for lost or damaged copy sheets with a minimum amount of operator intervention and efficient use of the machine operating components. In particular, for automatic duplex operation, the dedicated duplex tray is primed with certain copies of the documents to be copied in a predetermined sequence. Job recovery is an automatic procedure to reprime or add to the copy sheets already in the dedicated duplex tray to make up for lost or damaged copies in the set without necessarily having to reject a whole set having partial copies in process or copies destroyed in the operator intervention activity.

For a better understanding of the present invention, reference may be had to the accompanying drawings wherein the same reference numerals have been applied to like parts and wherein:

FIG. 1 is a block diagram of a preferred embodiment of a controller made in accordance with the present invention;

FIGS. 2*a* and 2*b* are schematics of a portion of a controller board (CMB) of FIG. 1 illustrating the microprocessor interconnections;

FIGS. 3*a*, 3*b* and 3*c* are electrical schematics of a portion of the controller board illustrating the ROM interconnections;

FIGS. 4*a*, and 4*b* are electrical schematics of a portion of the controller board illustrating the RAM interconnections;

FIGS. 5*a*, 5*b*, and 5*c* are electrical schematics of a portion of the controller board illustrating the circuitry for generating various interrupt and control signals;

Figure 1:
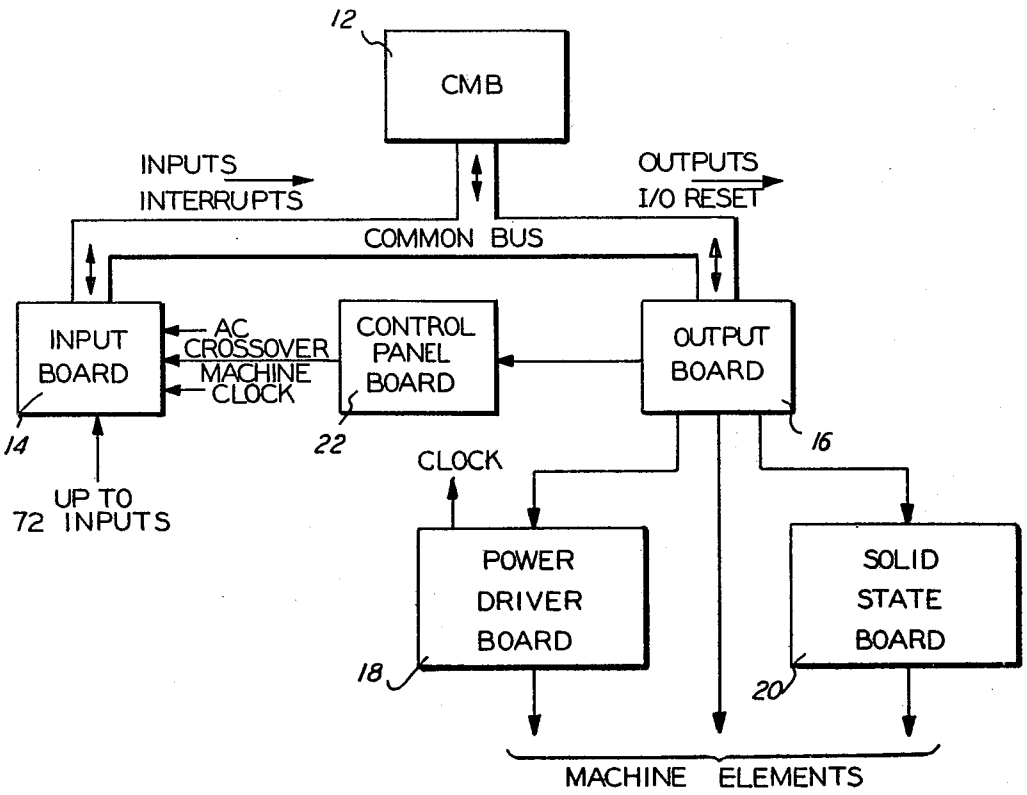

With reference to FIG. 1, there is generally shown a controller 10 for a reproduction machine including a computer memory board CMB 12, an input board 14, an output board 16, power driver board 18, and a solid state driver board 20 located in a card cage in the reproduction machine. The reproduction machine also includes a control panel board 22 and other not shown boards, for example, a fuser controller board and an automatic toner controller board. The CMB 12, input board 14, and output board 16 are interconnected through a common bus.

The input board 14 collects and organizes in a byte format up to 72 inputs from machine sensors and switches, readable on command by the computer memory board CMB 12. The input board 14 includes suitable data selectors and buffers as well as resistor networks for receiving the switch and sensor inputs. In addition, the input board 14 buffers external interrupt and trap lines namely, an AC zero crossover line, and a machine clock line.

The output board 16 receives byte formatted output data from CMB 12 and disperses up to 72 outputs directly for outputs requiring less than 300 milliamps of DC drive current or indirectly through the power driver board 18 and the solid state driver board 20 for heavier loads and for AC loads. In addition, the output board 16 can turn off all outputs upon receipt of an input/output reset signal from CMB 12.

The power driver board 18 controls DC outputs greater than 300 milliamps drive requirement and also a set of AC loads. For example, the power driver board 18 controls various motors through suitable opto insulators and thyristors and various solenoids through suitable transistors. The solid state driver board 20 controls various components and minimizes EME noise. For example, the solid state driver board 20 controls various heaters through suitable rectifiers and triacs and certain motors through suitable transistors and triacs. The output board 16 generally comprises suitable buffers, latches and drivers.

Figure 2A:
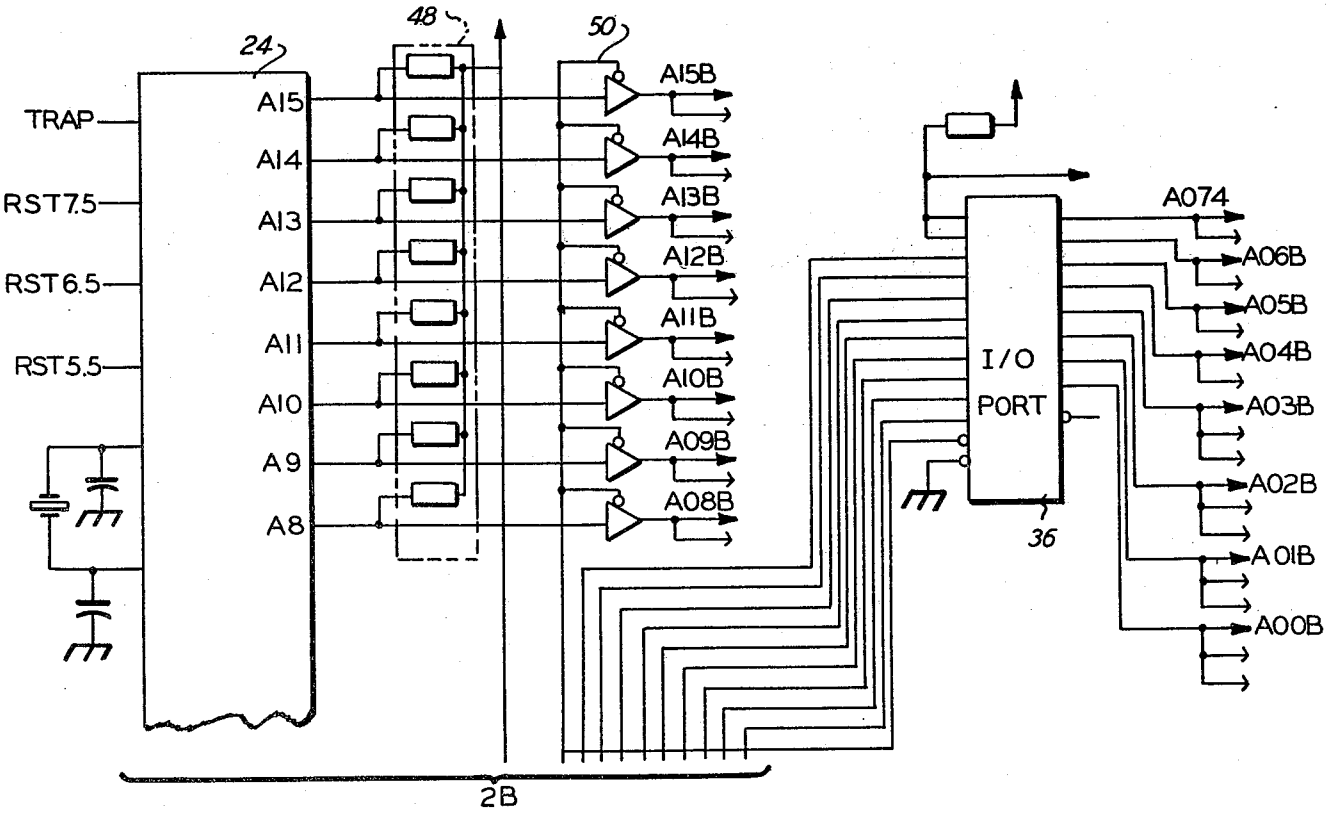
Figure 2B:
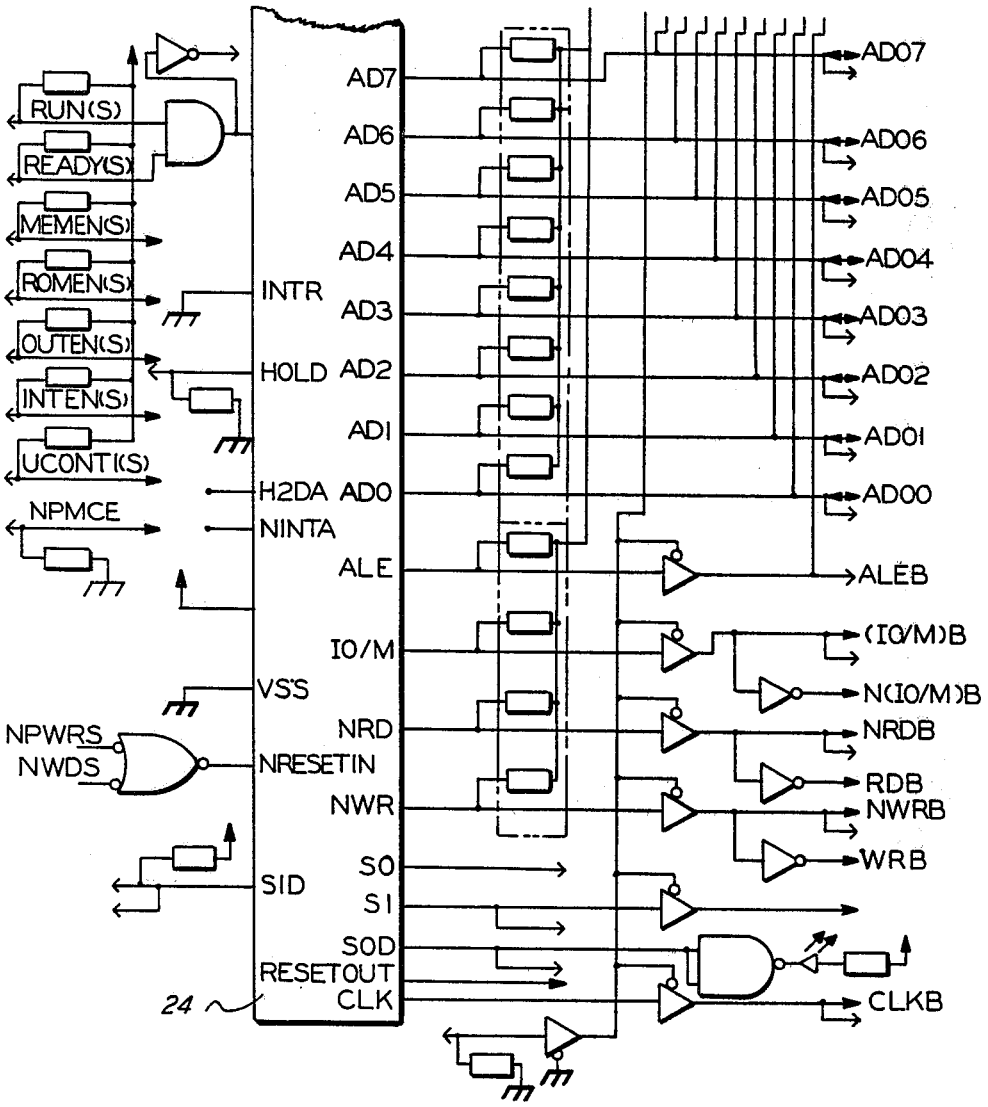
Figure 3A:
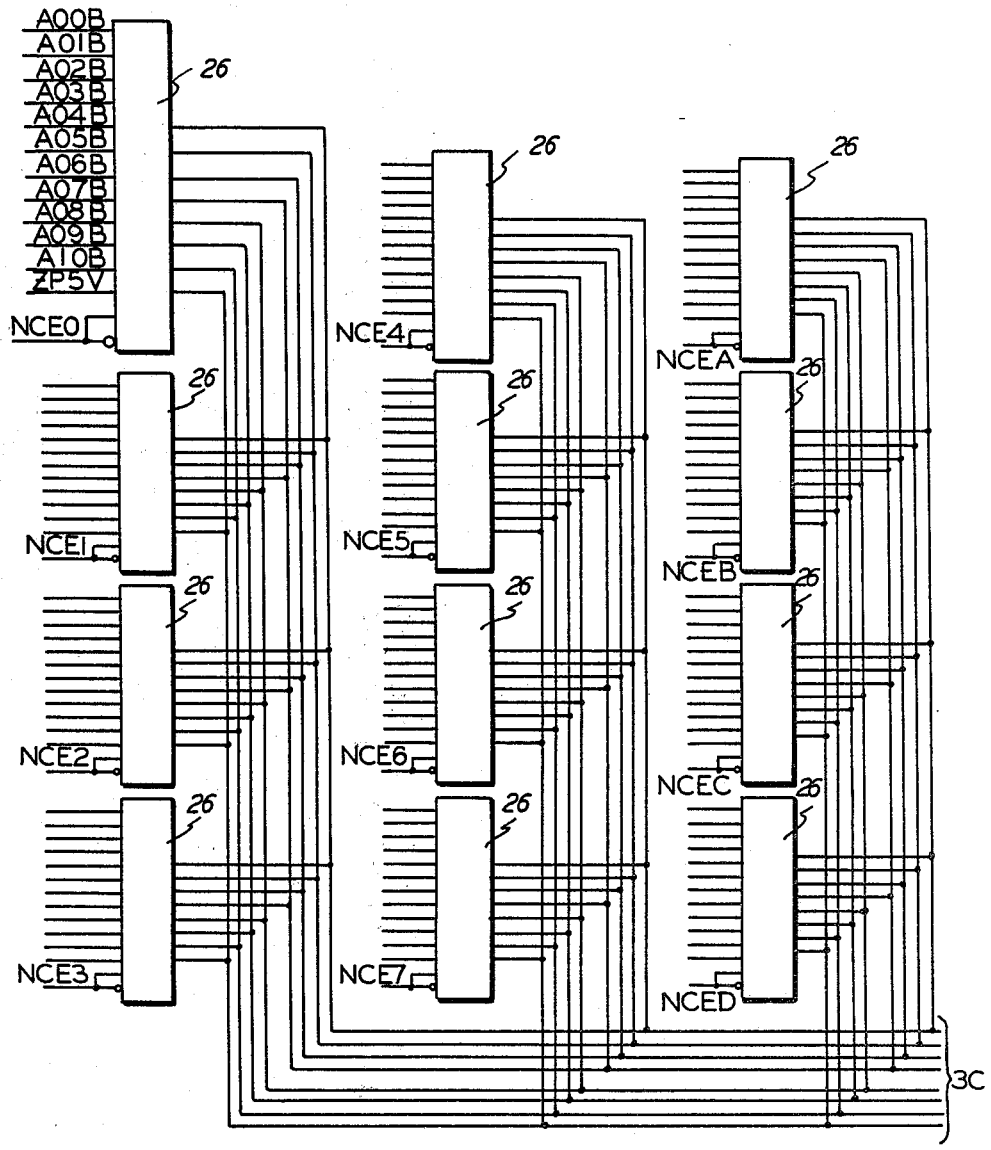
Figure 3B:
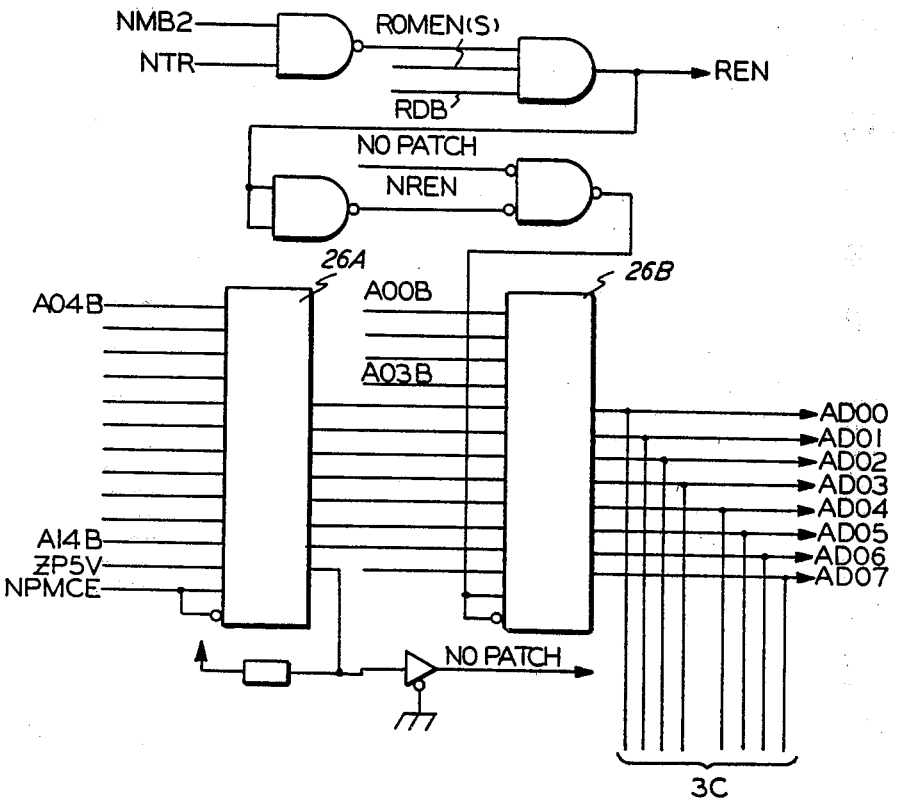
Figure 3C:
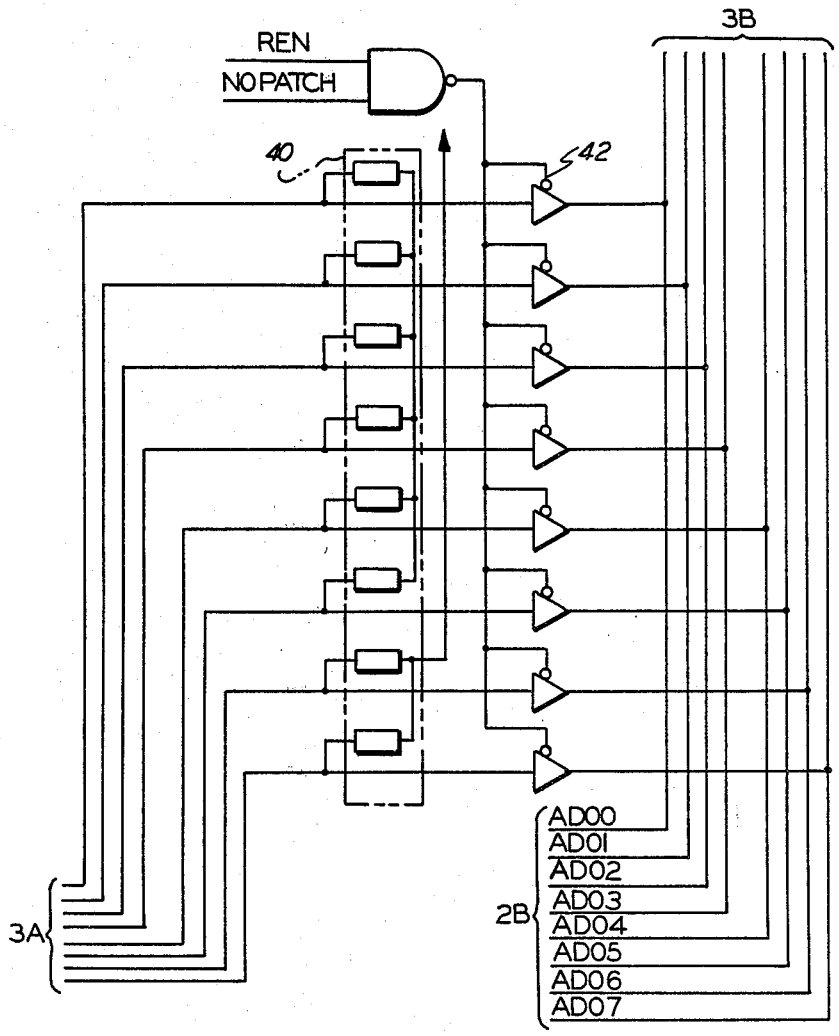
Figure 4A:
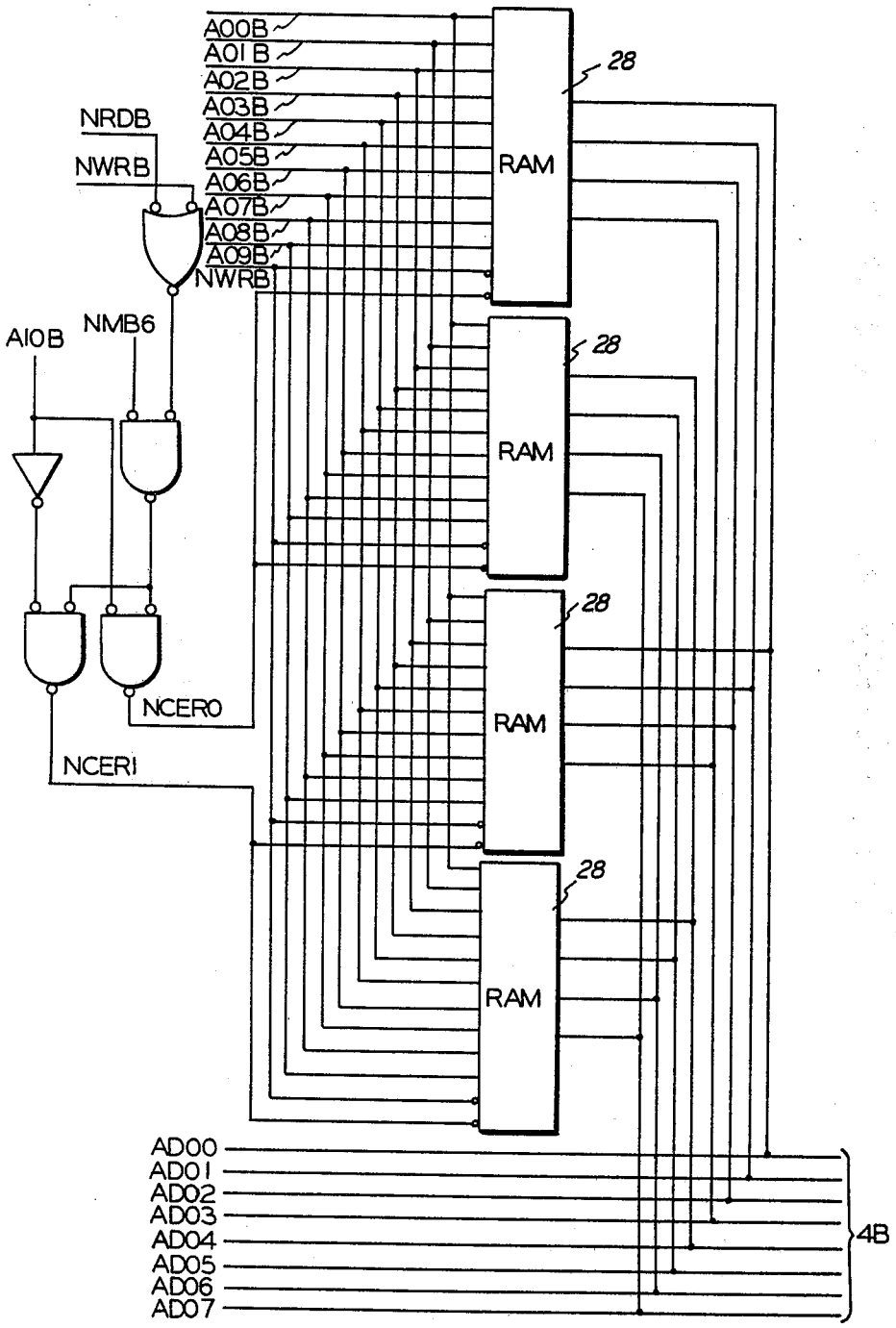
Figure 4B:
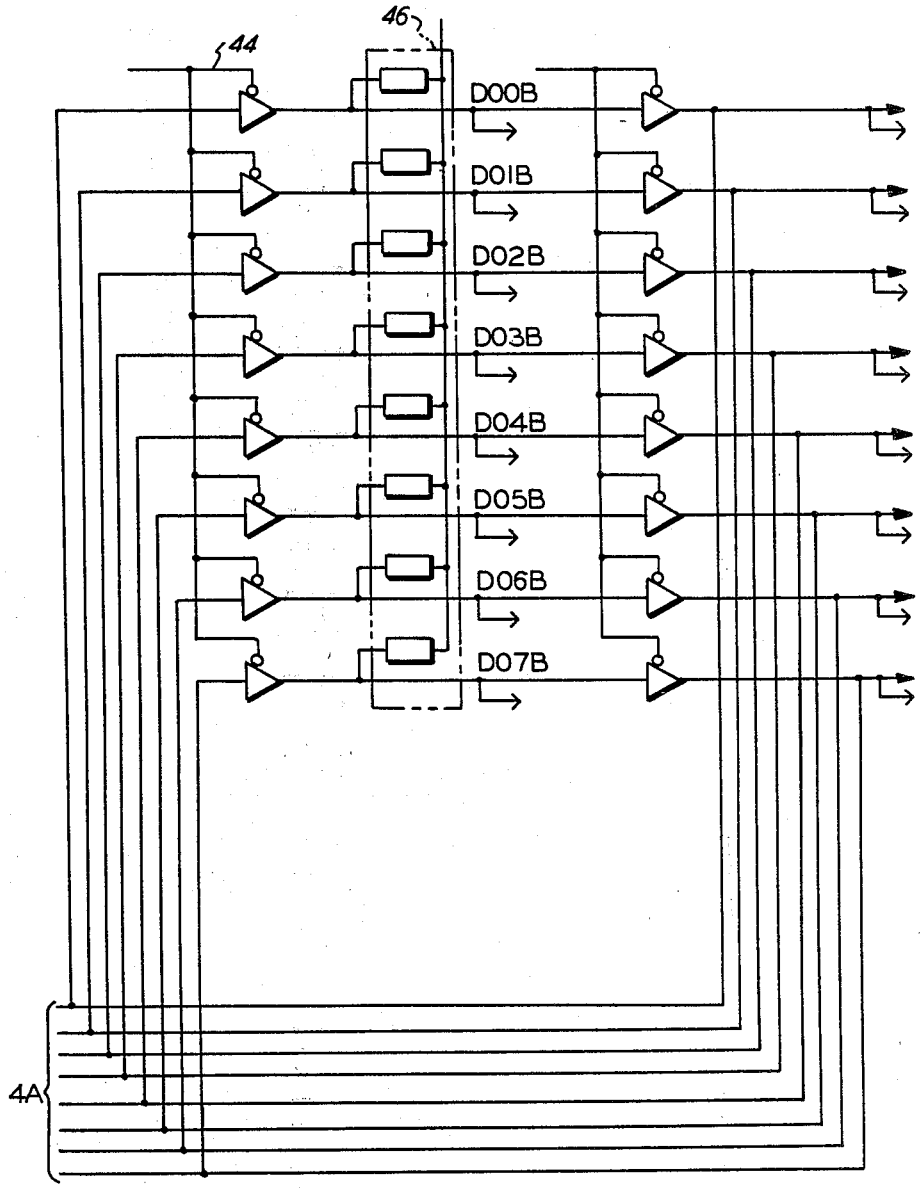
Figure 5A:
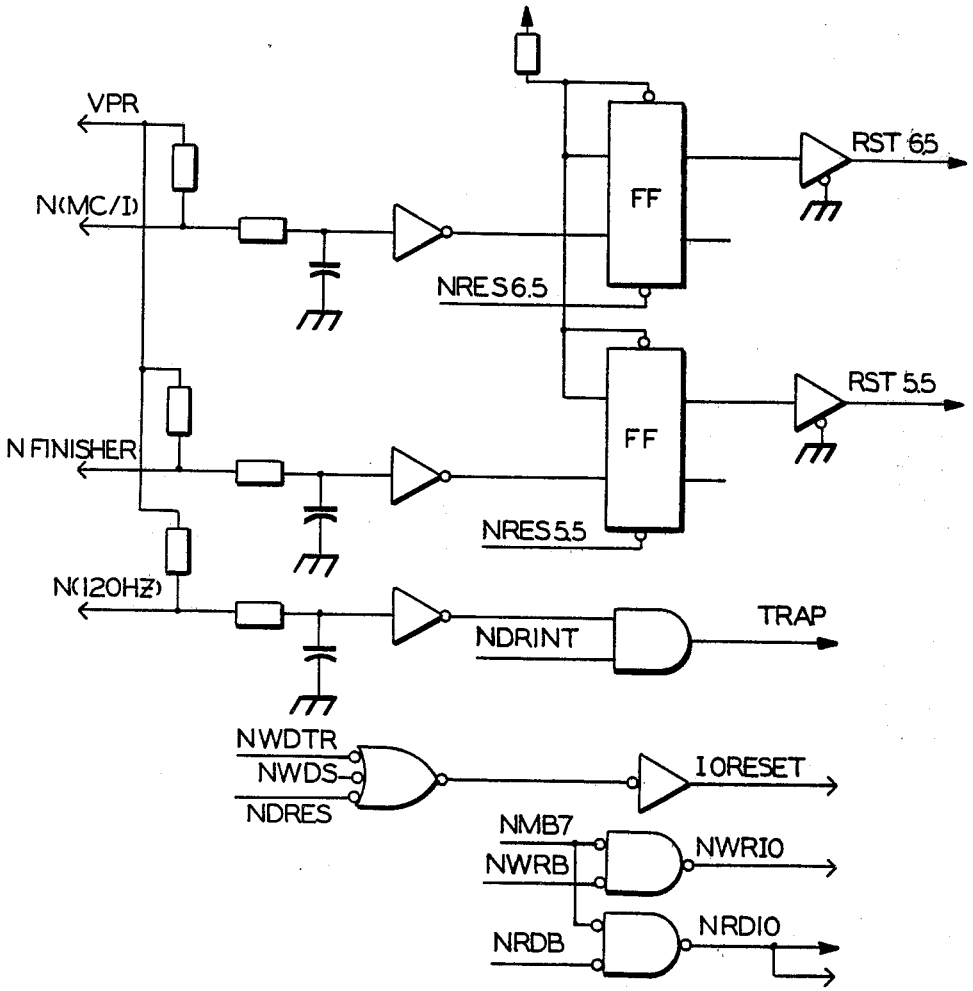
Figure 5B:
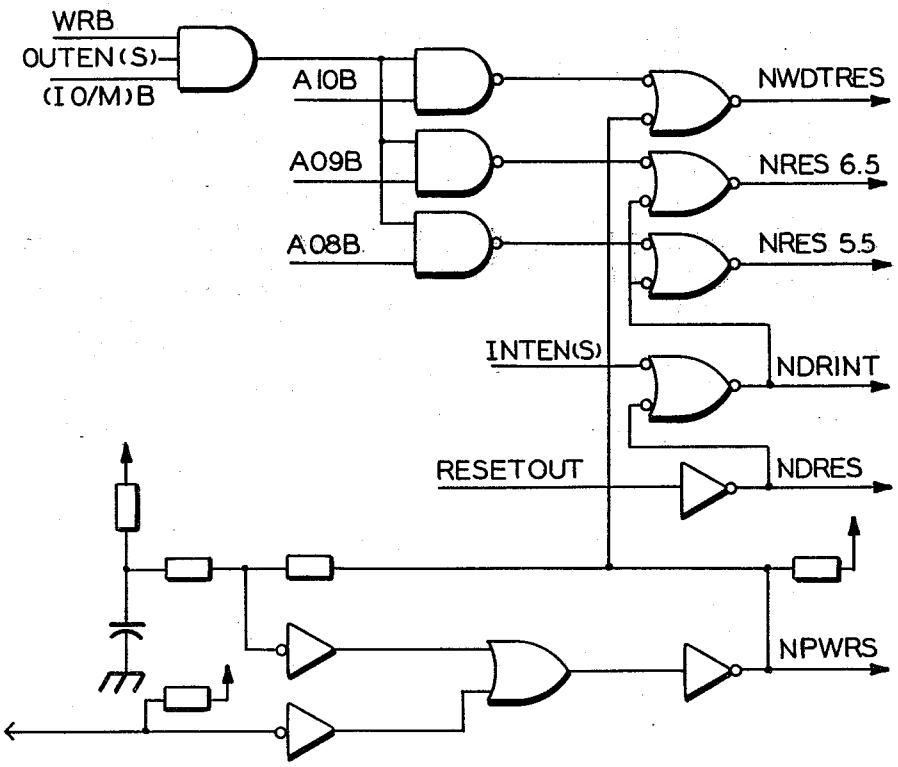
Figure 5C:
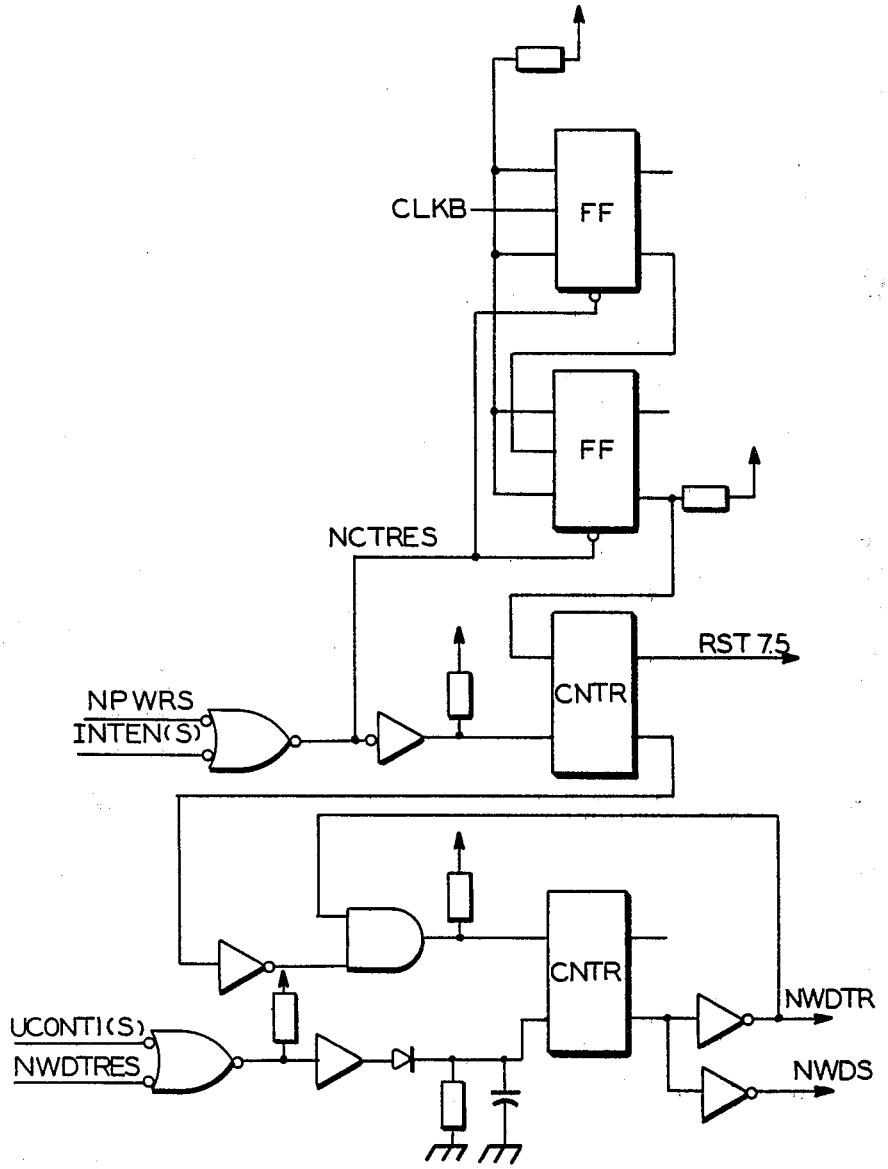
Figure 6:
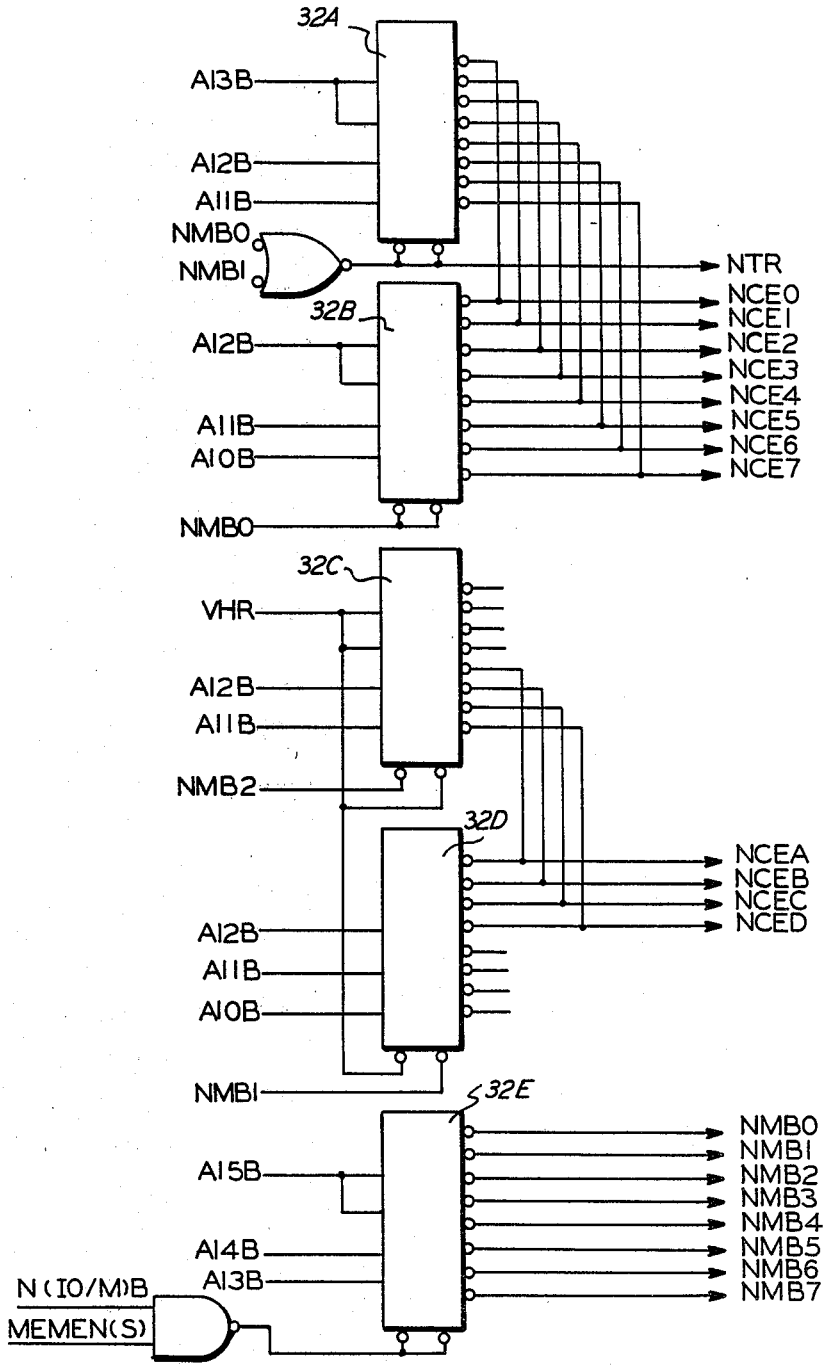
FIG. 6 is an electrical schematic of a portion of the controller board illustrating the select signals generated by various decoders.

The computer memory board 12 includes an Intel 8085 microprocessor 24, (FIGS. 2A and 2B), 18K bytes of read only memory, ROM 26, (FIGS. 3A and 3B), 1K byte of random access memory, RAM 28, (FIG. 4A) interrupt and traps (FIGS. 5A, 5B, 5C) as shown in Table I, a watchdog timer requiring reset at a period of less than 104 milliseconds, decoders 32 (FIG. 6) for memory mapped input/output and an on board LED for diagnostic purposes.

TABLE I

| INTERRUPT/TRAP SIGNALS | | | | |
|---|---|---|---|---|
| PRIORITY | SOURCE | 8085 NOMENCLATURE | INT/EXT | RESET REQ'D |
| 1 | Zero Crossover | TRAP | Ext | No |
| 2 | Real-Time Clock | RST7.5 | Int | No |
| 3 | Machine Clock | RST6.5 | Ext | "Out2" |
| 4 | Spare | RST5.5 | Ext | "Out1" |

*Note:
External signals processed through an RC Filter and a Schmitt trigger

Figure 7:
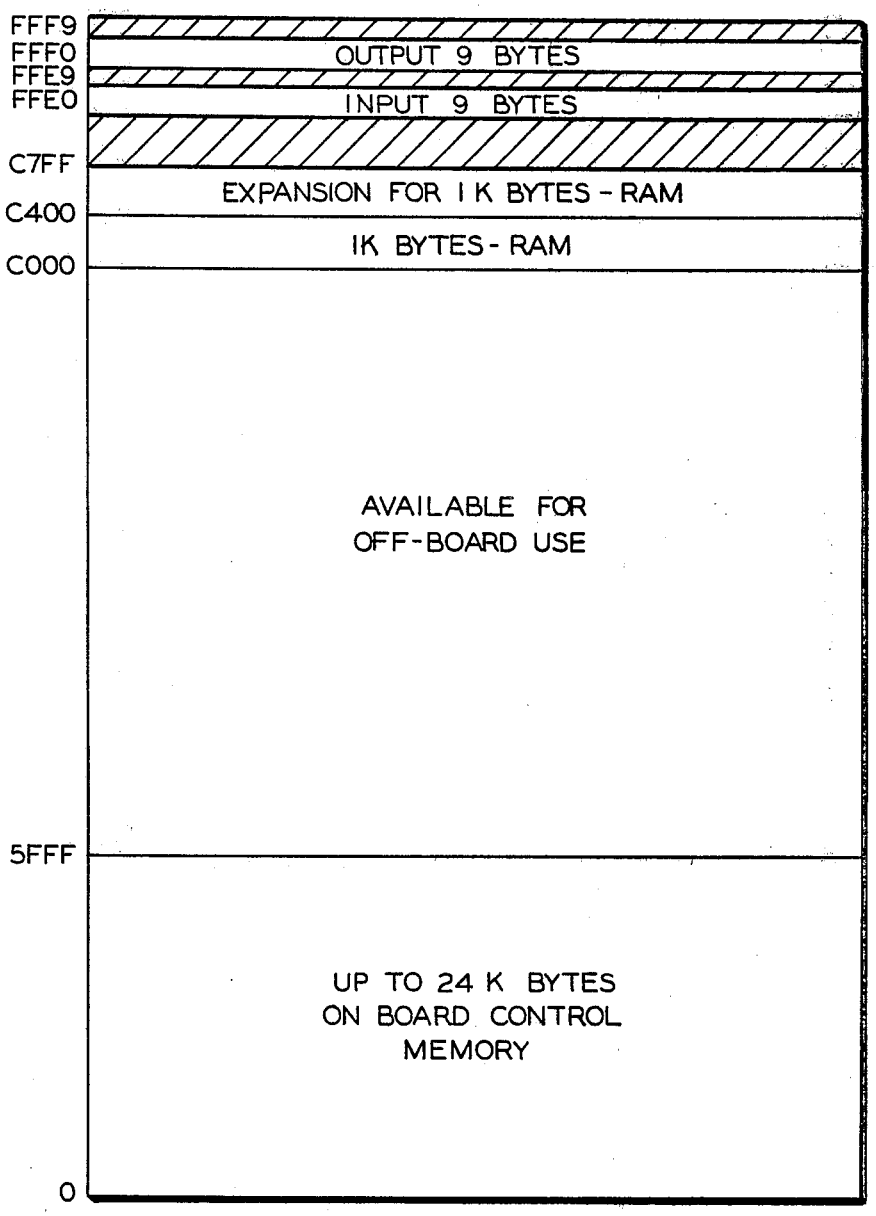
FIG. 7 is a memory map of the controller illustrated in FIG. 1.

FIG. 7 illustrates the controller memory map.

With reference to FIGS. 2*a*, 2*b*, 3*a*, 3*b*, 3*c*, 4*a*, 4*b*, 5*a*, 5*b*, 5*c* and 6, microprocessor 24 is connected to a suitable input, output port 36 such as a SCHOTTKY bipolar 8 bit input/output port, Intel Part No. 8212, read only memory ROM 26, random access memory RAM 28, and decoders 32*a*–32*e*. Read only memory ROM 26 comprises several ROM memory chips connected to address lines A00B through A10B and one ROM chip 26*a* connected to address lines A04B through A14B, and a ROM chip 26B connected to the output of ROM 26*a* and address lines A00B through A03B. Random access memory RAM 28 comprises a number of RAM chips each connected to address lines A00B through A09B. The outputs of the ROM chips are connected to data bus AD00–AD07 through a suitable resistor network 40 and buffers 42. The outputs of ROM 26B and the outputs of the RAM chips are also connected to the data bus AD00–AD07. The data bus is also connected to the output board 16 and input board 14 through a suitable buffer 44 and resistor network 46.

Address lines A08B–A15B are connected to pins A8–A15 of the microprocessor 24 through a suitable resistor network 48 and buffer 50. Address lines A10B–A15B also are connected to address suitable decoders 32A–32E, to produce memory chip select signals NCE0 through NCE7, NCEA through NCED, and NMB0 through NMB7. Data lines AD0 through AD7 at the microprocessor 24 are connected to the data bus AD0-0–AD07 through a suitable resistor network.

Figure 8:
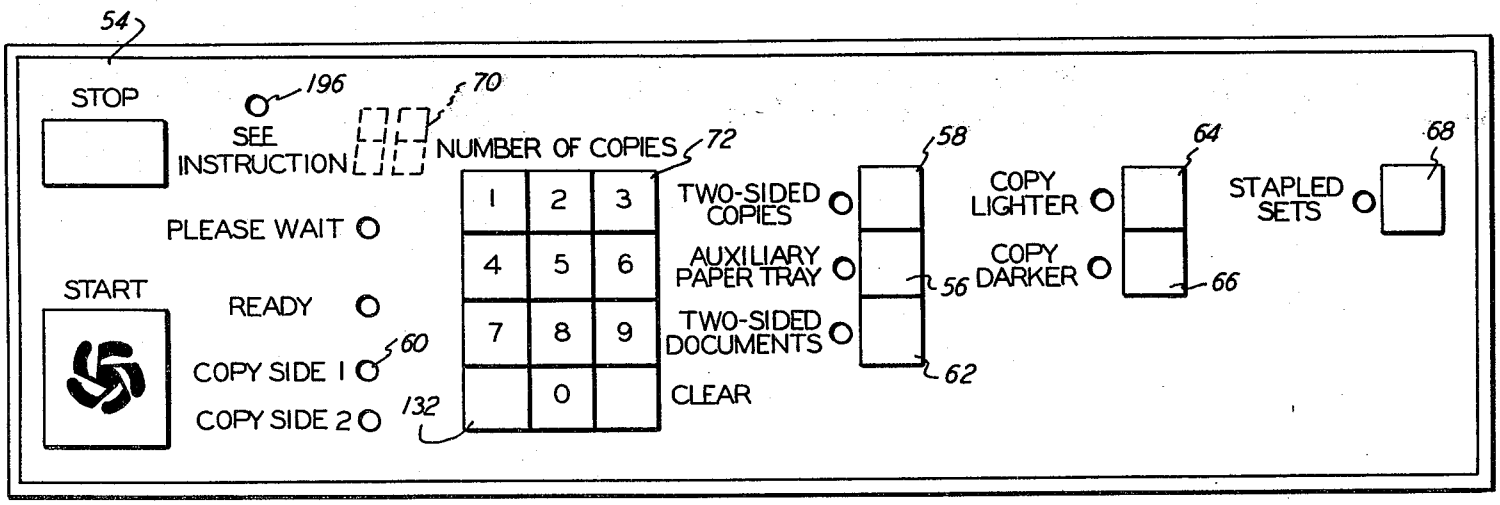
FIG. 8 is an illustration of the control panel portion of the control panel board of FIG. 1.

With reference to FIG. 8, there is shown the operator control console 54 illustrating selection switches and indicators. Upon selection of a particular mode, the appropriate lamps illuminate to indicate selection and the controller 10 will respond by controlling the machine for the mode selected.

When an operator selects a particular mode of operation, an indicator lamp is turned on to inform the operator of the mode selected, and the normal copying mode is altered to allow the machine to control the mode selected (e.g. auxiliary tray feeding versus normal main tray feeding).

Each mode selection switch serves a dual on/off function. Pressing a particular switch with the mode "off" will cause the mode to be selected. Pressing a particular switch with the mode already "on" will cause the mode to be cleared, eliminating the need for an additional mode clear switch.

In the normal copy mode, copy paper is fed from a main tray for one sided copies. Six other modes are available. In particular, pressing an auxiliary paper tray switch 56 will cause the auxiliary paper tray lamp to turn on, and will signal the controller 10 to allow the processor to feed from an auxiliary tray.

Pressing the two-sided copying switch 58 will cause the two-sided copying lamp and the copy side 1 lamp 60 to turn on and will also signal the controller 10 to allow the processor to automatically make two-sided copies. Selection of this mode signals the controller 10 to allow a document handler, if used, to operate in the two-sided copies mode.

Pressing the two-sided document switch 62, will cause the two-sided documents lamp to turn on, and will also signal the controller to automatically make copies of two-sided documents. Since making one-sided copies of two-sided documents is a disallowed mode of operation, selecting two-sided documents will automatically cause the two-sided copying mode to be selected.

Pressing the copy lighter switch 64 will cause the copy lighter lamp to turn on, and will automatically clear the copy darker mode if it was previously selected.

Pressing the copy darker switch 66 will cause the copy darker lamp to turn on, and will automatically clear the copy lighter mode if it was selected.

The normal copying mode output is stacks or offset sets. The stacks mode is defined as a number of copies in the copy output receiving area and each copy is made from the same original. The sets mode is defined as a number of copies in the copy output receiving area and each copy is made from a different original. Pressing the stapled sets switch 68 will cause the stapled sets lamp to turn on, and will also signal the controller 10 to allow the finisher to staple each completed set before depositing it into a lower output tray.

OPERATOR INDICATORS

The "ready" lamp is on, in standby, when the system is ready to go into the print state (the please wait and see instruction indicators are not on). The ready lamp is also on during the normal system shutdown cycle of manual platen input jobs within 0.5 seconds after the last required exposure scan of the original on the platen is complete. It can also be on when the system is in a diagnostic mode and is off during normal print cycles and wherein "please wait" or "see instruction" indicators are on. It also goes off in normal manual platen system shutdown cycles if the start print is pushed to restart a new job. Standby state is defined as any time none of the major subsystem drive motors is energized (RDH, processor, or finisher). It generally means the ready lamp is lit or the "see instruction" lamp is lit. The "see instruction" lamp is lit in conjunction with the display of predetermined status codes and a malfunction situation exists.

The "please wait" lamp is on anytime the controller 10 detects that the fuser roll is under temperature or the controller detects a fault and is in a jam shutdown state. It is also on when the system is in the diagnostic mode and off at all other times. The see instruction lamp is on when any instruction codes must be displayed to the operator. This indicator will turn on in conjunction with any given instruction code and will turn off when all instruction code are cleared. While the instruction code is being displayed, both the see instruction indicator and the quantity display will blink on and off. This indicator will be off at all other times.

The quantity display 70 will provide different types of information. In particular, if the system is in standby or ready the display 70 indicates the number of sets selected in the offset sets or stapled sets modes and indicates the number of copies selected if system is in stacks output mode. If the system is in a run cycle, the display indicates the number of the copy set being imaged in the offset sets or stapled sets modes and indicates the number of copies which have been imaged in the manual platen mode. If the see instruction indicator is illuminated, the display 70 indicates the appropriate instruction code. And finally, if the system is in a job recovery condition with the ready indicator illuminated, the display indicates the number of completed sets in process in offset sets or stapled sets output modes or indicates the number of completed copies if the system is operating in the manual platen mode.

Figure 9:
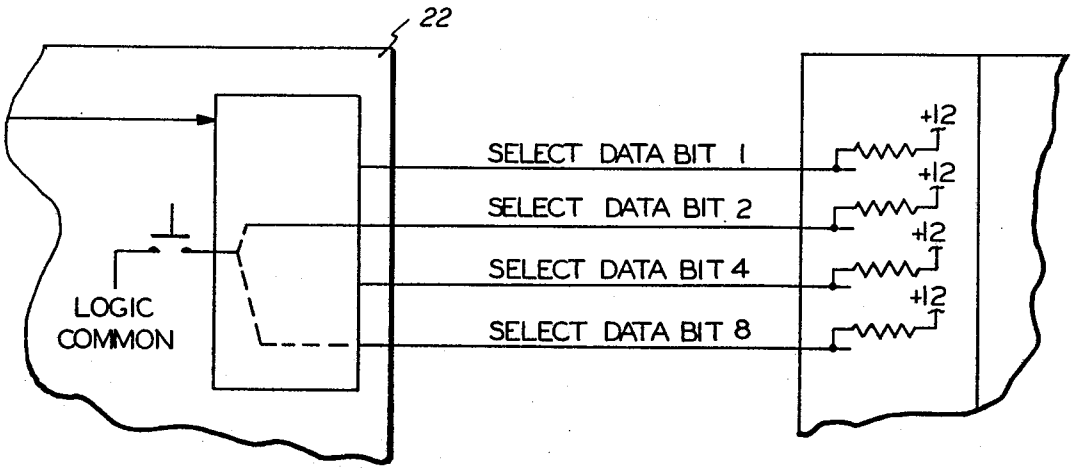
FIG. 9 is a typical logic interconnection of a quantity push button illustrated in FIG. 8.

A typical interconnection of a quantity selector switch to the computer memory board 12 is shown in FIG. 9. For example keyboard 72 selection information is supplied to the controller 10 using the following signals: Selection data bit 1, selection data bit 2, selection data bit 4, and selection data bit 8. These signals provide a binary coded decimal (BCD) input to the computer memory board CMB 12.

When a number (0–9) is selected, logic common is supplied to a not shown keyboard decoding circuit via the appropriate push-button. The decoding circuit switches Low those signals which are not required for the appropriate selection. The signals which remain High become the "active" BCD inputs to the system. When any selection data bit signal goes Low, the controller 10 senses that a push-buttom is pressed, and the controller 10 reacts to those signals which remain High.

For example, as illustrated in FIG. 9, push button number 5 is pressed (BCD 5=1+4).

Selection data bit 1 stays HI
Selection data bit 2 goes LO
Selection data bit 4 stays HI
Selection data bit 8 (H) goes LO.

When the computer memory board CMB 12 receives the BCD signals from the keyboard decoding circuit, it provides appropriate output signals, also in BCD form, to the digital display 70. The control panel board 22 latches and decodes these signals and displays the appropriate digit in the units position. When, as second pushbutton is pressed, the sequence is repeated and the appropriate digit is displayed in the units position and the previous number shifted to the tens position. Further keyboard selections will be ignored by the controller 10 until after the clear button is pressed. The mode selector switches interconnect with CMB 12 in other conventional arrangements.

Figure 10:
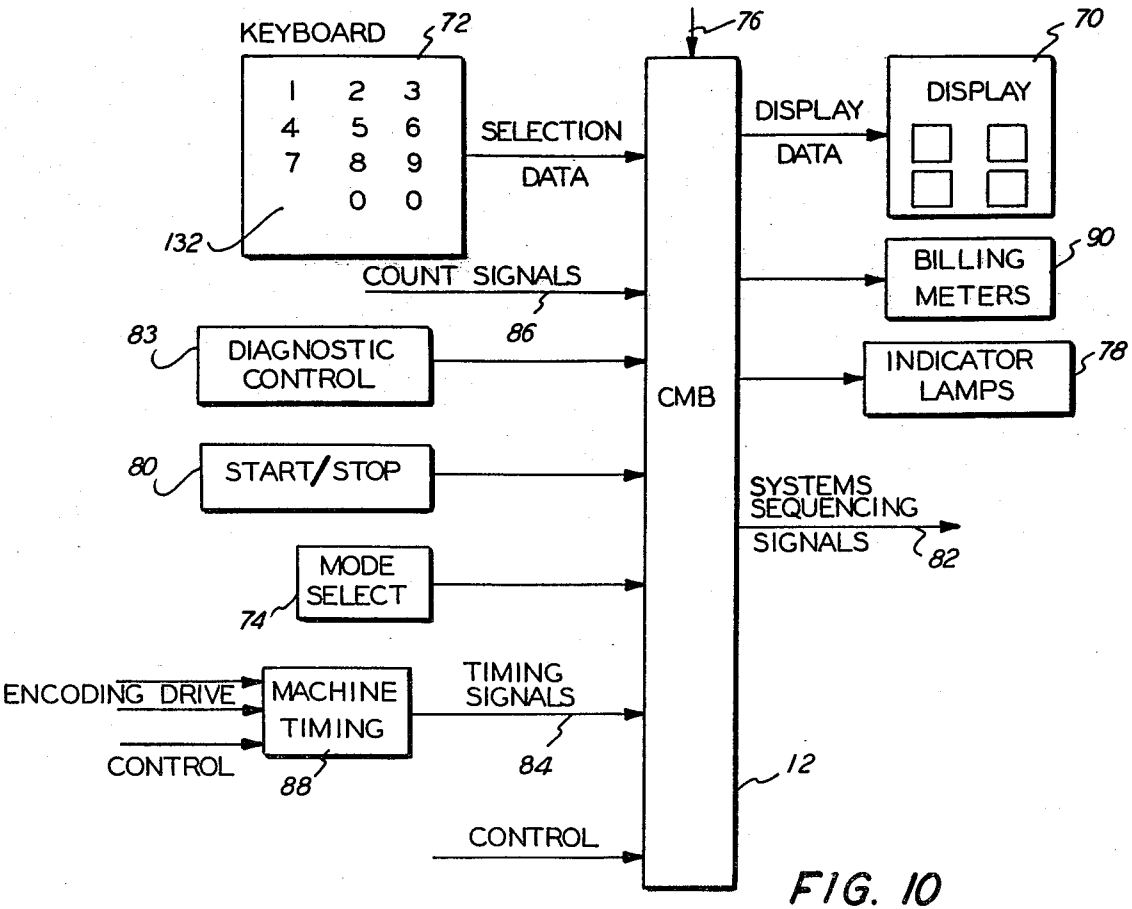
FIG. 10 is an illustration of the functional relationships of various elements of a reproduction machine with the controller board and control panel board illustrated in FIG. 1.

The functional operation of the controller 10 is illustrated with reference to FIG. 10. It should be understood that the controller 10 encompassed the various boards shown in FIG. 1, including CMB 12. Controller 10 receives operator mode selections 74 and keyboard 72 data, monitors machine conditions with monitor signals 76 and prevents machine operation until conditions are satisfactory. When satisfactory, a ready indication 78 is provided. Upon activation of the start button, 80, the controller 10 controls the operation of the process with signals 82, including a document handler and finisher if provided.

The diagnostic control 83 is used for entering the diagnostic mode, entering diagnostic programs, and displaying fault codes on the digital display 70. Diagnostic control is obtained by activating a not shown diagnostic enter switch. The controller 10 detects its input and causes the digital display 70 to indicate "dc". In the diagnostic mode, the tech rep can select five diagnositc programs, namely, component control, processor dead cycle, machine clock test, document handler exercise and controller self test. The diagnostic push button 132 (the unlabeled key 132 on the keyboard) switch has three functions; namely, (1) when the machine is in stand-by and the digital display indicates a status code, the button is pressed to cause the display to show the appropriate fault code, (2) when the diagnostic mode is selected, the button is used together with the keyboard clear button to enter a specific diagnostic program into the CMB 12 memory, and (3) when the component control diagnostic program is selected, the button is used to enter a specific input selection into the controller memory.

The controller 10 also monitors machine states with monitor signals 76 and the operation of the various components for example, the clutches, solenoids, power supplys. CMB 12 of controller 10 also receives appropriate count signals 86 and timing signals 84 from machine timing 88 to control and synchronize operation and activates appropriate billing meters 90. Billing meters 90 comprise 3 separate meters. In particular, a first billing meter counts the total number of paper feeds made from any of the processor paper feeders, main tray 110, auxiliary tray 112 or duplex tray 120. A second billing meter counts the total number of stapled sets completed by the finisher. The stapled sets meter signal is produced by the CMB 12 each time the CMB 12 energizes a not shown staple clutch in the finisher. A third billing meter counts side two copies by advancing one count each time a sheet is fed from the duplex tray 120.

During a machine copy cycle, a sequence of precisely timed events must occur in order to produce an output copy. The sequence starts when the start push button is pressed. The machine timing 88 of most of the reproduction machine elements and the RDH is controlled by a suitable (not shown) optical encoder assembly preferably including a clear plastic disc with 144 equally spaced black sections. The disc is mounted between a light source or LED and a phototransistor driver and the disc is driven by a shaft that makes exactly two revolutions for photoreceptor drum revolution. Upon disc rotation, the light beam from the LED is interrupted by the black sections of the disc. The phototransistor converts the light pulses into electrical pulses and these pulses are the machine clock timing signals 84.

The CMB 12 contains an internal counter that counts the number of machine clock pulses as the disc rotates. A timing reset signal is generated once for every pitch or copy cycle (2 pitches per drum revolution) in order that the controller timing can be synchronized with the machine timing. The timing reset signal is generated by a switch located on the optical encoder assembly and is actuated once every revolution of the disc drive shaft. The controller counts 144 machine clock pulses every revolution of the disc.

The machine clock pulses are used for sequencing most of the processor events during a copy cycle and also timing of paper travel through the processor for jam detection. At specific times, after a copy cycle has been initiated, a sheet of paper must be at a specific point in the paper path. The position of the sheet of paper is monitored by a path, switches and sensors and the timing is monitored by the controller counter. The controller uses this information to detect if the sheet has arrived or departed at a particular point at the proper time.

In operation, in general, the controller monitors the state of input signals and makes decisions to turn the processor components on and off at the proper time to produce output copiers. Processor operation is prevented until certain conditions are met, for example, fuser ready. When all necessary conditions are satisfactory, pressing the start print button will initiate the operation.

A 120 hertz clock input signal is generated by a clock circuit on the power driver board 18. This clock is synchronized with a 60 hertz 24 VAC input and is used in the CMB 12 as a control signal to turn on outputs from the output board 16.

The count signal 86 to CMB 12 is a set counter sensor signal located in the recirculating document handler RDH to be described. The CMB 12 also increments a count internally each time a copy paper feed is scheduled from various machine trays.

The controller 10 also contains a real time clock circuit controlling among other functions, a four minute timer. This timer will automatically be started when the machine is in the standby state and either of the following conditions exist: Ready lamp is on with any mode selected, job recovery condition does not exist and the digital display is displaying any number other than one or "see instruction" is on relating to certain instruction codes.

Figure 11:
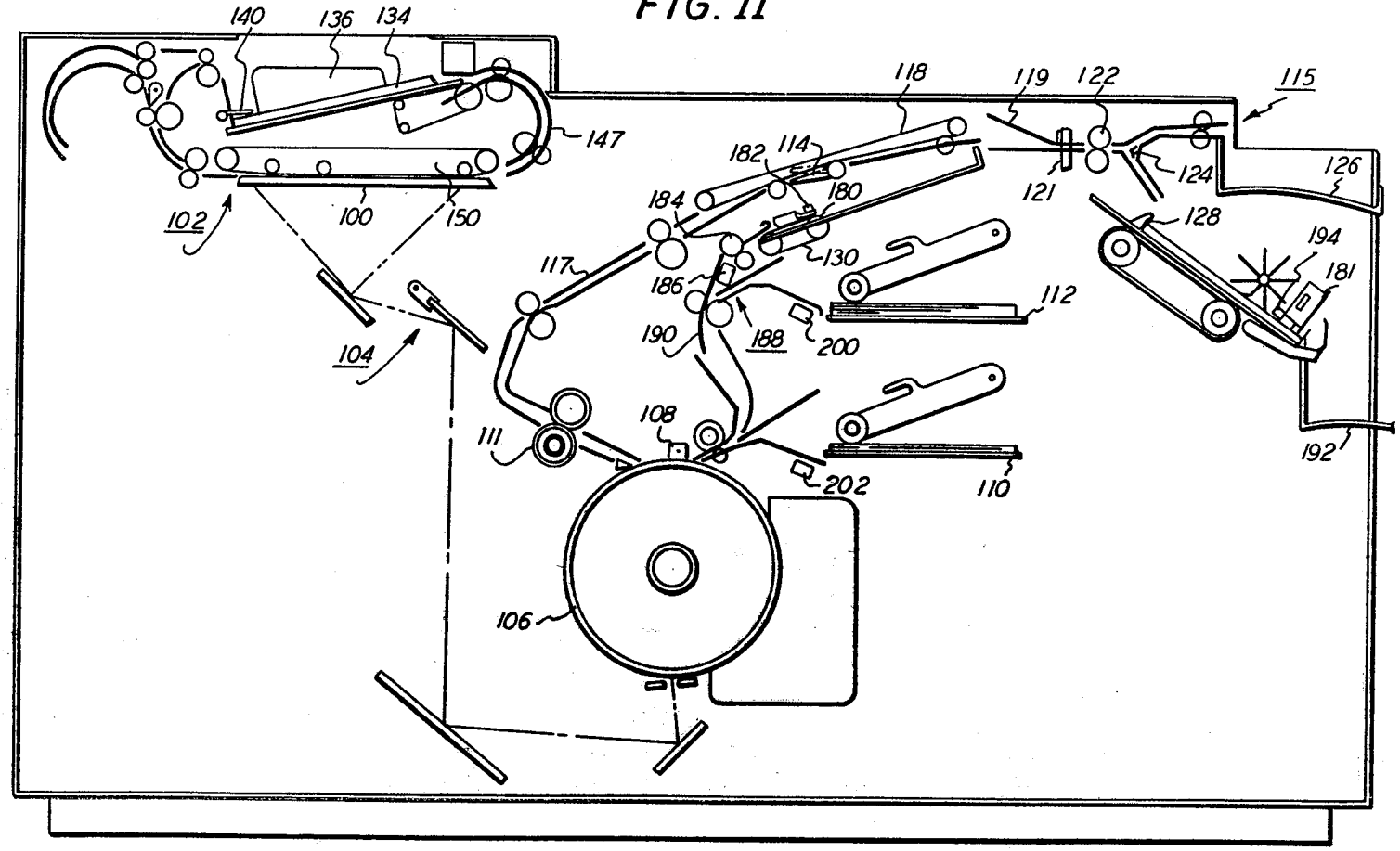
FIG. 11 is an elevational view of a reproduction machine controlled in accordance with the present invention.

With reference to FIG. 11, there is illustrated a reproduction machine operating under control of controller 10.

There is generally shown an imaging station 100 of a pre-collation recirculating document handling unit (RDH) 102. Also shown is an optics system 104 for imaging each document image onto a photoreceptor 106. The photoreceptor 106 has the normal imaging, development, transfer, stripping, and cleaning stations to develop the document image on the photoreceptor 106 with fusable toner material and to transfer that toner image to one side of a copy sheet at a transfer station 108. The transferred copy page image is then fused to the copy sheet at the fusing station 111. Clean (unimaged) copy sheets may be fed into the transfer station 108 from either of two copy sheet trays 110 or 112. After the transfer and fusing of the copy sheet image has been accomplished on one side, the copy paper output path transports it on transport 117 toward an exit area. However, first it passes by a movable gate or deflector 114. Depending on the position of this sheet deflector 114, the copy sheet will either continue on transport 118, or be temporarily captured and stored in a duplex buffer tray or bin 120.

After the sheets have been duplexed (or if the copier is being operated in a simplex copying mode) the copy sheets exit the copier processor through the output transport 118 rather than being deflected into the duplex bin 120. As illustrated, the transport 118 conveys sheets to the finishing area generally indicated at 115. In particular sheets are conveyed through baffle 119 to offset and drive rolls 121, 122. A deflector 124 provides for selecting between a catch tray 126 or compiler tray 128. It should be noted that the compiler tray 128 is only required for those machines having a stapler 181. The stapler 181 capability need not be provided in all machines and some aspects of the present invention apply to machines with or without staplers.

The tray 120 has a bottom sheet feeder 130 for feeding sheets individually out from the bottom of the tray 120 onto a sheet feeding path toward the transfer section 108 for the transfer of the second (opposite) page image to the second (opposite) side of these previously simplexed copy sheets which were temporarily stored in the duplex bin 120. The sheet feeder 130 feeds sheets from the opposite side of the buffer set from which the sheets are normally being fed into the buffer set by the deflector 114. This maintains the proper page order of the simplexed copy sheets in the duplex bin 120.

By way of one example, assume a single copy set of a five page document set is being provided in an duplex mode. After a precount slew, page 4 is first copied on one side of a first clean copy sheet fed from tray 110 or 112 and deflected into duplex bin 120 by deflector 114. When page 2 is copied onto one side of a second copy sheet and placed on top of the first copy sheet in the duplex bin 120. Page 5 is then copied on a clean sheet fed from tray 110 or 112 and ejected to the offset and drive rolls 121, 122 of finisher area 115. The sheet feeder 130 is then actuated to feed out the bottom sheet from the tray 120, (which is the first sheet with page 4), to the transfer station 108 where page 3 is placed on the opposite side of that copy sheet. The deflector 114 is then moved to its alternate position so that this first sheet, which is now fully duplexed, is ejected from the copier through the offset and drive rolls 121 and 122, rather than returned to the duplex bin 120. The sheet feeder 130 then next feeds the second sheet, bearing page 2, out of the bin 120 and the page 1 image is copied on its opposite side, and this second sheet is likewise ejected from the copier.

While in the above-example the copying system is a n to 1 page order pre-collation copying system with a buffer set of the even pages copied first, it will be appreciated that the present system may also be utilized in a 1 to n order pre-collation copying system, and with either even or odd pages simplexed first.

In the manual platen mode, an original is placed on the platen, a number of copies programmed and the digital display is advanced one count by the controller CMB 12 for each paper fed from the main, auxiliary, or duplex copy trays 110, 112, 120, respectively.

In the document handler or sets mode, the digital display indicates sets rather than individual copies. This is the only mode that requires a count input to the CMB 12. When a set circulation is begun through the document handler, the set counter sensor 128 signal is received at CMB 12. That is, the CMB 12 causes the digital display to advance one count on the first RDH feed of every set. This process repeats for each set circulated through the document handler.

DOCUMENT HANDLER

Figure 12:
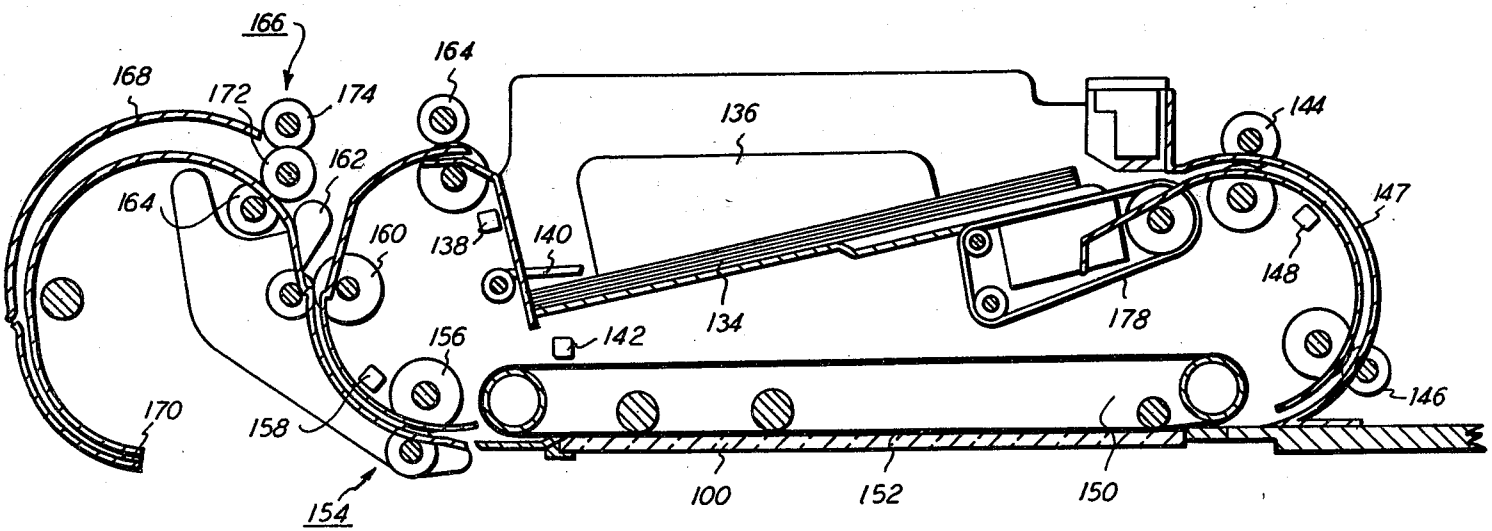
FIG. 12 is a detailed elevational view of the recirculating document handler as shown in FIG. 11.

The recirculating document handler (RDH) 102 shown in detail in FIG. 12 is selected by placing a set of documents face up into the input tray 134 defined by paper guide 136. The number of desired copy sets is entered via the control console keyboard 72. When start is pressed, the document handler moves each document starting with the bottom document of the set from the input tray 134 to the platen 100, then returns the document to the input tray. One completed copy set is produced when the last document of the set (top document) is exposed on platen 100 and transported back to the document handler input tray 134. If more than one copy set is requested, the process will be repeated until the desired number of copy sets has been produced. In accordance with the present invention, the document handler operates in three modes: (1) one sided copies from one sided originals, (2) two sided copies from one sided originals and (3) two sided copies from one sided originals, a special duplex tray being used in duplex requirements.

The two sided copies push button 58 and the two sided document push button 62 signals are sensed to determine which of the three document handler modes has been selected. Timing reset signals provide the timing information to insure that the document handler components operate in synchronism with the processor components.

Preferably, an input tray sensor 138 is used by CMB 12 to determine if documents have been loaded into the document handler input tray 134. The sensor 138 is a two piece sensor consisting of an emittor or light source and detector. During an initial count or slew cycle, the CMB 12 counts the number of documents contained in the set as cycled by the RDH. The slew cycle is also used by the RDH to cycle originals before a job start to invert originals if necessary.

A set separator or finger 140 separates documents in a set to be copied from those documents that have already been copied and returned to input tray 134. Upon command of the CMB 12, a not shown set separator clutch is energized and the set separator finger 140 rotates and falls onto the trail edge of the top document in the input tray 134. A set counter sensor illustrated at 142 normally produces a first signal with the separator finger 140 located on the document stack. The finger 140 on top of the stack allows light to be sensed by counter sensor 142. However, when the top document (last document in the set) is fed, the set separator finger 140 falls through a not shown slot blocking light from the set counter sensor 142 and this signal indicates to the CMB 12 that the last document of the set has been fed.

During document feed, drive is supplied to take away rolls 144 and platen entry drive rolls 146. The document coming from the input tray 134 is transported by the take away rolls 144 to a wait station 147 including a wait station sensor 148. Upon sensing of a document by wait station sensor 148, the take away rolls 144 are inactivated and the document remains at the wait station 147 until the previous document has been exposed. The document at the wait station is then fed to a platen transport 150. The platen transport 150 is secured to the input tray 134 support frame and includes a document belt 152 supported by suitable rollers for driving a document onto platen 100.

When a document is about to be conveyed to the platen transport 150, the CMB 12 energizes a not shown platen forward clutch and platen reverse clutch to register a document on platen 100. After the document has been exposed, the platen forward clutch is energized and the document is transported by document belt 152 to a return transport area generally shown at 154 and the next document is accepted from the wait station 147. The return transport area 154 includes exit drive rollers 156, platen exit sensor 158 and middle drive rollers 160. Platen exit sensor 158 is used by the CMB 12 to monitor document movement off the platen 100 and through the lower portion of the return transport area 154.

If a one side original copy mode has been selected, a not shown inverter gate solenoid is not energized and the document is driven past inverter gate 162 to the upper drive roller 164. The upper drive rollers 164 feed the document passed the input tray sensor 138 to the input tray 134. The input tray sensor 138 provides signals to the CMB 12 to monitor document movement through the upper portion of the return transport 154.

During two sided original copying, the inverter gate solenoid is energized, and the documents are diverted by the inverter gate 162 to the lower nip 164 of the drive rollers 166. The document is driven around an inverter baffle 168 until the lead edge reaches an inverter pad 170. As the middle inverter drive roll 172 rotates, the edge of the document is conveyed from the lower nip 164 to the upper nip 174 of the inverter drive rolls 166 and the inverted document is then driven by the inverter drive rollers 166 to the upper drive rollers 164 and into the input tray 134.

The set counter sensor 142 signal manifests to the CMB 12 that the last document of the set has been fed to the wait station. During document handler operation, a not shown document counter located in the CMB 12 counts each document fed. When the set counter sensor 142 signal is sensed by the CMB 12, the number of document feeds recorded by the document counter (representing the number of documents in the set), is stored in memory and the document counter is reset.

The document counter is used to detect if more than 50 one sided documents or 25 two sided documents are present in the input tray 134, whether an odd or even number of documents is present in the input tray in the one sided document two sided copy mode, and if a multifeed (a feed of 2 or more originals at one time) has occurred. The CMB 12 monitors document movement and shuts down the document handler and displays a status code if a document jam or multifeed occurs. A fault code indicating the exact cause of the fault, is displayed upon activation of the unmarked keyboard 132 button.

ONE SIDED ORIGINAL/ONE SIDED COPY MODE

After the first document is fed from the wait station 147 to the platen 100, and the exposure scan begins, the CMB 12 signals for the second document to be fed to the wait station 147. In particular, a vacuum transport 178 feeds the bottom document forward to the takeaway rolls 144. The bottom document is fed by the takeaway rolls 144 to the wait station sensor 148. The wait station sensor 148 signals the CMB 12 that the document is at the wait station 147. CMB 12 then provides signals to remove the drive from the vacuum transport 178 and takeaway rolls 144. The document is then positioned at the wait station 147. After the document on the platen 100 is exposed, CMB 12 signals for the second document to be fed from the wait station 147.

The document on the platen 100 is fed to the return transport area 154 while the document at the wait station 147 is fed to the platen 100. The document is now positioned on the platen 100 for the start of the new exposure scan. There were no missed exposure scans, that is, the entire document feed sequence, from wait station 147, to a platen 100, took place during the return scan of a not shown exposure lamp.

When a document feed is initiated from wait station 147 to platen 100, the document on the platen 100 is fed to the return transport area 154. The platen exit sensor 158 signals CMB 12 that the document has reached the sensor.

The platen exit drive rollers 156 drive the document to the middle drive rollers 160. The middle driver rollers 160 drive the document to the upper drive rolls 164 driving the document into the input tray 134. The document is now positioned on top of the document stack in the input tray 134.

The sequence of document feed to wait station 147, and document feed from wait station 147 to platen 100 continues until the last document of the set (top document) is fed to the wait station 147. At this time, the set separator finger 140 falls and is sensed by the set counter sensor 142. The set counter sensor 142 signals the CMB 12 that the last document (top document of the set) is at the wait station 147.

If only one copy set is requested, the CMB 12 will inhibit any more document feeds from the input tray 134 and will shutdown the document handler after the last document of the set is exposed and returned to the input tray 134. If more than one copy set is requested, the sequence repeats over again for the next copy set. The set separator clutch is energized to position the set separator finger 140 when the last document of the set is exposed and returned to the input tray.

SPECIAL REQUIREMENTS

TWO-SIDED ORIGINALS/TWO SIDED COPY MODE

After a set of documents is placed in the input tray 134 and the print cycle is started, the inverter gate solenoid is energized. The document handler circulates and inverts each of the documents so that the even side of the documents are ready for copying first. After the recirculation cycle (slew cycle) is completed, the copy cycle begins.

The sequence of operation for document movement and position is identical to the One-Sided Original/One-Sided Copy Mode. During the initital set run cycle, the document handler registers the even side of the documents on the platen 100 for one exposure scan (copies of these documents are fed into the duplex tray 120). The documents are changed between exposure scans and are inverted before being returned to the input tray 134. There are no missed exposure scans during document changes.

After the initial even side run cycle is completed, the document handler registers the odd sides of the document on the platen 100 for exposure (the copies of the even sides stored in the duplex tray 120 are fed to the transfer station 108 at this time). The documents are again changed between exposure scans and inverted before returning to the input tray 134. The document handler continues the even/odd exposure cycles until the last programmed set (odd side) is being copied. During this cycle, the documents are not inverted prior to being returned to the input tray 134.

During the slew cycle, CMB 12 also counts the number of documents that are in the set. If CMB 12 senses that there are more than 25 documents in the set, the slew cycle will be halted, and a status code displayed informing the operator to remove the excess documents.

SPECIAL REQUIREMENTS

One Two-Sided Original—If there is only one document in the set, the odd side of the document is first registered on the platen 100 for exposure. The document remains on the platen 100 until the number of exposure scans equals the copy quantity selected (a maximum of 25 copies is allowed). The copies of the odd side are fed into the duplex tray 120. Next, the even side of the document is registered on the platen 100 for copying. The copies of the odd side stored in the duplex tray are fed to the transfer station 108 at this time. After the last even copy is made, the document is inverted and returned to the input tray 134 and the document handler shuts down. Note that if less than five copies are selected, exposure scans will be missed between the odd side and even side exposure to allow enough time for the first odd copy to reach the duplex tray 120.

ONE SIDED ORIGINALS/TWO-SIDED COPY MODE

After a set of documents is placed in the input tray 134 and the print cycle started, the document handler circulates and counts each of the documents to determine if the set contains an even or odd number of documents. This information is used by CMB 12 to determine whether each registered document is an even or odd numbered page. CMB 12 can then properly control the processor paper path. After recirculation, the copy cycle begins.

The sequence of operation for document movement is identical to the One-Sided Original/One-Sided Copy Mode. Each document, starting with the bottom document, is fed to the platen 100 for one exposure scan and is returned to the input tray 134 after exposure. However, during the initial set run cycle, the machine 10 only makes copies of the even documents (these copies are fed into the duplex tray 120). There is one missed exposure scan while each odd document is on the platen 100.

During all subsequent set run cycles, excluding the last one, copies are made of each document (copies of the even documents are loaded into the duplex tray 120 while copies of the odd documents are placed on the second side of the copies fed from the duplex tray 120). There are also no missed exposure scans during document changes.

During the last set run cycle, the processor only makes copies of the odd documents (the copies of the even side, stored in the duplex tray 120, are fed to the transfer station 108 at this time). There is one missed exposure scan while each even document is on the platen 100.

During the recirculation or slew cycle, if CMB 12 senses that there are more than 50 documents in the set, the recirculation cycle will be halted, and a status code displayed informing the operator to remove the excess documents.

SPECIAL REQUIREMENTS

One One-Sided Original—If there is only one document in the set, the job will automatically be run as a two-sided original two-sided copy requirement.

Two One-Sided Originals—If there are two documents in the set, the bottom document will be fed to the platen 100 and remain on the platen 100 until a number of exposure scans equals the copy quantity selected (a maximum of 25 copies is allowed). The copies of the bottom document are fed into the duplex tray 120. Next, the top document is fed to the platen 100 for copying. The copies stored in the duplex tray 120 are fed to the transfer station 108. After the last exposure is made, the top document is returned to the input tray 134 and the document handler shuts down. If less than five copies are selected, exposure scans will be missed between even side and odd side exposures to allow enough time for the first even copy to reach the duplex tray 120.

Three One-Sided Originals—If there are three documents in the set, there will be one missed exposure scan between even side and odd side exposures to allow enough time for the first even copy to reach the duplex tray.

PAPER FEED AND REGISTRATION

The paper feed and registration system accepts copy paper loaded by the operator and delivers it at the proper time to meet the lead edge of the developed image on the photoreceptor surface 106 at the transfer station 108. For single sided copies the copy paper is fed from either the main tray or auxiliary tray 110, 112. For two sided copies, the side one copies are fed from the duplex tray 120. The duplex tray 120 has a capacity of 25 side 1 copies, and is located above the auxiliary tray 112.

The duplex tray 120, a main tray 110 and auxiliary tray 112 have (not shown width and length adjustments guides. These guides actuate suitable switches producing signals to CMB 12 manifesting the paper size the tray is set to receive. If Two Sided Copying is selected, and the duplex tray 120 and the main or auxiliary tray 110, 112 lengths and widths are not set the same, the machine will not print.

After the side 1 copies have been properly positioned in the duplex tray 120, the machine 10 will prepare for side 2 copies by placing a bail bar 180 on top of the copies as illustrated in FIG. 11. The bail bar 180 is placed on top of the copies in order to apply pressure between the copies and the feed belt 130. This pressure causes the friction required for the feed belt to feed copies.

The bail bar 180 is flipped at various time in response to signals from CMB 12 as determined by the job requirement. For example, jobs with two originals will require that as soon as the even side copy is in the duplex tray 120, the bail bar 180 be flipped and the copy fed out. Bail flip is accomplished by energizing and de-energizing two (not shown) solenoids. The solenoids cause the bail bar to move in two directions, horizontally from under the stack of copies and vertically above the copy stack.

There are also four special conditions under which the bail bar 180 is flipped, namely, at the beginning of all new copying jobs after the start print button is pushed, after all job interruptions when the system is operating in the duplex tray mode and the machine is allowed to complete copies that are in process, anytime the machine processor starts up during a duplex tray mode job recovery situation and the CMB 12 has determined that all copies in the duplex tray must be removed (purge) and during all job recovery cycles, CMB 12 controller determines at what point the job shall be resumed and if the bail bar 180 needs to be flipped to re-order the duplex tray.

A bail sensor illustrated at 182 composed of a mirror, phototransistor and an infrared light source (LED) at the bail bar 180 signals the CMB 12 that copies, blocking light from the LED, are located in the duplex tray 120. When no copies are in the duplex tray 120, the light source emits light that is reflected by the mirror back to the phototransistor, providing a signal to the CMB 12 that no paper is present in the duplex tray 120. After the bail bar goes through its flip cycle, the light to the phototransistor will be blocked by the copy in the duplex tray.

Only the bottom copy will be fed from duplex tray 120 due to force applied by the belt 130 to the bottom side of the bottom copy. All copies above the bottom one will have drag exerted on them by a retard pad (not shown), thus breaking any friction that exists between the copy being fed and the next sheet on top of it. This action ensures that only one sheet is fed at a time from the duplex tray 120. The single copy is fed into the nip of the duplex tray drive rolls 184.

The copy that enters the nip of the duplex tray drive rolls 184 is driven to a wait sensor 186, signaling the CMB 12 that a copy has arrived at the duplex wait station 188. The copy remains at the wait station until shortly before the start of the copy scan that corresponds to the sheet that is at the wait station 184. The copy is then fed into the transport 190 to the transfer station 108.

In accordance with the present invention, job interruptions and automatic recovery generally follow a heirachy of complexity, including the extent of activity of the operator, to correct the malfunction and the sophistication of the recovery itself. For example, different responses are required for the following interruptions: add paper, processor misfeeds, processor jams, processor multifeeds which do not jam, RDH jam, RDH multifeed, RDH input tray overfilled, finisher paper jam during staple operation, and staple jam.

In an add paper interruption, the controller CMB 12 detects that the main or auxiliary tray 110, 112 is emptied during a run. If the RDH is in operation, the original is held on the platen 100. If the original is being changed at the time of interruption, the original change is completed and the new original is held on the platen 100. All copies in process are completed and cycled in normal operation to the appropriate output receiving tray while the machine executes a normal shutdown cycle and all job information is stored. The operator has two alternatives at this time to either select an alternate feeder or add paper.

For job recovery, after all instruction codes are cleared, the digital display 70 reverts to displaying the quantity indicated at the time of the job interruption. Job recovery as in all recovery procedures is accomplished automatically when the start print is pushed and the system resumes the job where left off. Another interruption is a staple jam detected when a not shown staple cam driving the stapler 18 fails to return to its home position in time after a staple cycle has been initiated. If the RDH is in operation, it completes any original change that may be in progress and then holds its position. All copies and process are completed and cycled to the appropriate receiving area and again the normal shutdown cycle is initiated and all job information is stored.

At the finisher area 115, however, there is an immediate stop and all copies cycling out of the processor are run into catch tray 126. No operator action is available and the operator must call a service representative for jam clearance. There is no job recovery and the system is inoperative until serviced. The controller CMB 12 will also check when the system is powered up to see if the stapled cam is at its home position.

The add paper interruption is merely a pause in the operation of the reproduction machine and minimal operator intervention is required, namely add paper or switch to an alternate tray. The staple jam is an extreme situation requiring system shutdown and no operator intervention is available to continue operation. Between these situations are various other interruptions requiring different levels of operator activity and automatic job recovery for the system to continue on with operation.

RDH Job Recovery

An RDH original jam is detected when various conditions occur such as the document fails to reach or pass the RDH wait station sensor 148 in time, the document fails to pass the wait station sensor 148 in time, the document fails to reach the RDH platen exit sensor 158 or fails to pass the platen exit sensor 158 in time, or the document fails to reach or pass the RDH tray enter sensor 140 in time. In this situation, the RDH is immediately stopped by stopping all drives. As in other interruptions, all copies in process are completed and cycled to the appropriate output receiving area in use either catch tray 126 or comiler tray 128, and the normal shutdown cycle is initiated and all job information is remembered or stored.

Before this happens, however, if a copy sheet is fed from a sheet feeding area corresponding to the jammed document that did not make it to the platen, this copy sheet is cycled to the output receiving area, preferably to the tray not in use, either catch tray 126 or compiler tray 128.

In general, there are various alternatives for purging unwanted copy sheets corresponding to jammed documents in the RDH. In the staple mode of operation, preferably the unwanted copies are purged to the catch tray 126. Alternatively, however, the unwanted copies are purged to the compiler tray and become part of the stapled set. In this situation, after job recovery and completion of the set, the set will be completed but contain an additional blank or partially blank copy sheet.

In the non-staple mode of operation, preferably, the unwanted copy sheets are purged to the compiler tray 128. Alternatively, the unwanted copy sheet is conveyed to the catch tray 126 and again becomes merely an additional blank or partially blank copy in an otherwise complete set or stack. Preferably, the unwanted copy sheet will not be counted or billed. The operator action is to clear the entire RDH paper path and restack the document set in the input tray 134 in its original order (L to N).

As in all previous cases, job recovery is accomplished automatically when start print is pushed after the jam is cleared as follows:

If there are one sided originals, the system recirculates documents without exposing them until the document corresponding to the one which was being brought onto the platen at the time or the jam is on the platen. The system resumes the job normally from this point.

If there are two sided documents and the jam occurred while the even sides were being copied, the RDH recirculates the entire set inverting each document before it is deposited in the input tray 134. The RDH then recirculates additional documents until the original corresponding to the one which was being brought to the platen at the time of the jam is on the platen 100. Documents returning to the input tray 134 are inverted during this cycle and the system then resumes the job.

If there are two sided documents and the jam occurs while the last odd side set is being copied, the system recirculates documents without inverting them until the document corresponding to the one being brought onto the platen at the time of the jam is on the platen. If the jam occurs during any other odd side set copy cycle, the RDH recirculates documents until the document corresponding to the one being brought onto the platen at the time of the jam is on the platen (originals returning to the input tray are inverted during this cycle). The system then resumes normally from this point.

If the jam occurs during the initial slew cycle in two sided copying, the system starts the job over and if a jam occurs after all required copies have been made, the system indicates clear RDH and then the display indicates job complete. If a jam occurs during the job recovery slew cycle, the appropriate job recovery cycle is started over.

Another RDH interruption is an RDH multifeed which successfully feeds. In other words, each document set is counted as documents are circulated through the RDH. If a given document set is shorter than the others, a multifeed is detected and the operator is instructed to re-order the set in original order 1-N. All copies in process are delivered to the appropriate output receiving tray and the system is shut down normally. For one sided documents and two sided copies, if the multifeed occurs during the document count cycle or the initial duplex tray priming cycle, all copies in process are completed normally.

During job recovery, after start print, the system shuts down normally. The duplex tray is primed, that is, an initial placement of a set of copies of even numbered documents in the duplex tray 120 in appropriate order for feeding during the second half of the duplex operation. In all other cases all copies in process are completed normally, the system recirculates documents as before, and the system shuts down normally. However, all copies in the duplex tray 120 are cycled to the output receiving area as part of an incorrect set.

For two sided documents, all copies in process are completed normally, the system recirculates documents until they all return to the input tray, any copies in the duplex tray are cycled to the output catch tray 126 as part of the incorrect set, and the system shuts down normally. The operator action is to remove the incorrect set from the output receiving area, reorder the originals 1-N in the RDH and push start print to resume the job. After multifeeds involving two sided documents, the operator must also re-order the document set and replace it in the input tray.

In job recovery for one sided documents, one sided copies, the digital display 70 indicates the number of correct sets in the output receiving area and the number of documents counted during the first job recovery cycle is used for multifeed detection. For one sided documents, two sided copies, the digital display indicates the number of correct sets in the output receiving area and the document set is recirculated without being exposed to verify the number of documents in the set. The number obtained is then used for multi-feed detection. The system again recirculates the entire document set exposing the even originals to re-prime the duplex tray and the job is then resumed normally.

For two sided documents, in job recovery, the digital display indicates the number of correct sets in the output receiving area and the document set is recirculated through the RDH without being exposed and returned to the input tray after being inverted in order that the even sides of the document are ready for exposure. The documents are also counted during this cycle and the number obtained is used for multifeed detection.

Other interrupts in the RDH mode are detecting that the RDH input tray 134, is overfilled or that a document is left on the platen 100 from a previous job. In the overfill situation, the documents are counted as the first copy set is made for one sided copy and for two sided copies, the originals are cycled and counted prior to the start of the job.

For one sided copying, the system initiates a shut down after the fiftieth original is brought to the platen and copied. If the system is operated in the staple mode, the first fifty copies are deposited in the stapled set output tray 192. The system stops with all documents in the RDH input tray 134. Originals N through N-50 are above the set separator arm 140 and the remainder are below the set separator arm.

For one sided originals, two sided copies the system stops during the RDH document count cycle with all the documents in the input tray. Originals N through N-50 are above the set separator arm 140 and the remainder are below the set separator arm.

For two sided documents the system stops during the RDH document count cycle as above with all originals in the input tray. Two sided documents N through N-25 are above the set separator arm 140 and the remainder are below the set separator arm.

The operator must reduce the input set to 50 one sided documents or 25 two sided documents and job recovery is accomplished automatically when start print is pushed in particular, the job is restarted.

At the start of all jobs involving the use of the RDH, the platen belt 152 cycles and documents left on the platen 100 are detected by sensor 158 when exiting the platen. The RDH continues to run until the detected document reaches the input tray 134 and then the RDH stops. The operator must clear the document from the input tray and press start print.

Finisher Job Recovery

Other job interrupts independent of the processor elements of the reproduction machine are, for example, low staples detection. A sensor in the finisher illustrated at 194 will detect a low staple condition, in particular, a minimum of 10 usable staples left. If the job in process requires less than 10 additional sets, the system completes the job and shuts down normally. If the system requires more than 10 additional sets, the system completes the copy set in progress and then shuts down normally. As in all interrupts, the see instruction lamp 196 illuminates in conjunction with the display of the appropriate instruction code. The operator can clear the staple mode and restart the job in the non-staple mode or add staples and resume operation.

A finisher paper jam when the system is operating is detected by various not shown switches in the finisher area. If the RDH is in use, the RDH completes any document change that may be in progress and then holds its position. All copies in process are completed and cycle to the appropriate finishing area tray and the normal shut down sequence is initiated. The finisher will generally stop immediately except in certain specific situations. The see instruction lamp 196 illuminates in conjunction with the appropriate instruction code when the jam is detected. The operator must clear the entire finisher paper path including the compiler, if in use, close the finisher top cover and push start print to resume the job.

During staple mode job recovery, the digital display 70 indicates the number of complete sets in the sets output receiving tray 192 and follows the following sequences. For one sided copies, the system recirculates the document until the documents are in their initial order in the input tray 134. In one sided original two sided copies, the system recirculates the documents until they are in their initial order in the input tray 134, any sheets in the duplex tray 120 are cycled to the output catch tray 126, the complete set of even documents are exposed to re-prime the duplex tray 120, and then the system resumes normal operation.

For two sided originals, two sided copies, except when the jam occurs during the last finisher set cycle, the system recirculates any remaining odd documents of the set back to the RDH input tray 134 if the odd side of the document set is still being processed. The documents are inverted before being returned to the input tray 134. Any sheets in the duplex tray 120 are cycled to the output catch tray 126 and the system resumes operation. If even sides of a document set are being processed at the time of the jam, the system goes to a set boundary and resumes the job normally where it left off. If the jam occurs during the last finisher set cycle, the operation is generally the same except that the odd originals are not inverted when returned to RDH input tray. The whole set is recirculated to make the even sides of documents ready for copying. The job resumes normally. If in non-staple mode, recovery is the same as for processor jams.

PROCESSOR MULTIFEEDS WHICH DO NOT JAM

For one sided copies, processor multifeeds will not be detected and will result in extra blank copies in the output. For two sided copies, and RDH input with two one side documents or one two sided document in the set, multi-feeds are not detected. Any extra copies in the duplex tray 120 are processed normally and result in extra blank output copies for main or auxiliary feeder multifeed or missing output copies for a duplex feeder multifeed. For two sided copies and RDH input with more than two one sided documents or one two sided document, the system detects multifeeds with the set separator 180 in the duplex tray 120. If the last copy of the set feeding out of the duplex tray 120 does not correspond to the last document in the set, a multifeed is detected.

For the automatic feed of one sided documents and more than two documents in a set, when the multifeed is detected, all copies in process are cycled out normally to the appropriate receiving area. Any extra sheets of the incorrect set in the duplex tray 120 are processed as part of the incorrect set before the shutdown cycle is complete. The RDH completes any document change in process and then holds its position. The automatic feed of two sided documents with more than one document in a set is the same as the above. The indicator for multifeed for the automatic feed using the RDH, is a 5F instruction code. In the case of a 5F instruction code, the operator must remove the top set from the appropriate output tray and then push start print to resume the job.

Job recovery for automatic feed of one sided document, two sided copies (more than two documents in the set) includes the digital display 70 indicating the number of complete two sided copy sets in the output receiving area. The system recirculates documents (if necessary) until the first document of the next set, is on the platen. The system then resumes normally.

For the automatic feed of two sided documents for two sided copies and more than one document in the set, the remaining document of partially completed sets are returned to the input tray 134 without being inverted if the multifeed occurs during the last set. The entire set is then recirculated, inverted and returned to the input tray. The first document of the set is brought onto the platen 100 and the job is resumed from that point.

If the multifeed occurs during any other set, recovery is generally the same except that remaining documents of the partially completed set are recirculated, inverted and returned to the input tray. The first original of the set is brought onto the platen and the job resumed.

PROCESSOR MISFEEDS

Processor misfeeds are detected by the failure of a sheet feeding from the duplex tray 120 to arrive at the duplex wait sensor 186 in time, failure of a sheet feeding from the auxiliary paper tray 112 to arrive at the AUX sensor illustrated at 200 in time, failure of a sheet feeding from the main paper tray 100 to arrive at the main count switch illustrated at 202 in time, and the duplex tray bail switch 182 bar failing to capture any sheets in the duplex tray 120 during its cycle.

If in RDH operation, the RDH completes any document exchange that may be in process and then holds its position. In the processor, the paper feed in process is stopped immediately. All other copies in process are completed and cycled to the appropriate output receiving area while the processor executes its normal shut down cycle. All copies cycling out of the processor are processed normally.

The see instruction lamp 196 illuminates in conjunction with code 6C for a misfeed in the duplex tray, 7C for a misfeed in the auxiliary tray and 8C for a misfeed in the main tray area. For main or auxiliary tray misfeeds, the operator clears the misfeed sheet per the instructions. For duplex misfeeds, the operator clears all sheets in the duplex tray.

The job recovery sequence for main or auxiliary misfeeds for one sided documents, one sided copies determines if the document on the platen 100 does not correspond to the next copy required in an output receiving tray. If so, the system recirculates documents without exposure until the correct document is on the platen and then resumes.

For one sided documents, two sided copies with more than two documents in the set, the digital display 70 reverts to the number of the set in progress in the finisher area (output receiving area) 115. If the document corresponding to the next copy required in the duplex tray is not on the platen, the system recirculates documents until it is on the platen and then resumes operation.

For two sided documents and two sided copies with more than one two sided document in a set, the digital display reverts to the number of the set in progress in finisher area 115. In job recovery if the document which corresponds to the next copy required in the duplex tray is not on the platen, the system recirculates documents without exposure until it is on the platen.

The documents are recirculated as follows:

1. Remaining even document are recirculated and stacked in the input tray 134.
2. The entire odd set is recirculated and staked in the input tray.
3. Additional even documents corresponding to any copies in the duplex tray 120 are recirculated and stacked in the appropriate input tray.

For duplex tray 120 misfeeds, job recovery for RDH feed of more than two one sided documents is as follows. The digital display indicates the number of the copy set in progress in the finishing area 115. During job recovery, the system recirculates documents without exposure until a set is in sequential order in the tray (document one on top). If a partial copy set is complete in the output receiving area, the system recirculates its documents corresponding to the completed copies of the partial set without exposing them. The copies of the partial set at the output receiving area count 2 if they are two sided copies and 1 if they are single sided copies.

If at least one additional complete set is required to complete the job, one complete set of documents are exposed (starting with the next even document required in the output tray) to re-prime the duplex tray. The job is then resumed normally starting with the next even docuemnt (if a partial set is in the output tray) or document N (if there is a no partial set in the output tray).

If less than one additional set is required to complete the job remaining, even documents of the set in progress are exposed to re-prime the duplex tray 120. The system then recirculates additional documents until the odd document corresponding to the next odd copy required in the output tray is on the platen 100. The system then resumes the normal set copy cycle from this point.

For the automatic feed of two sided documents and more than 1 two sided document in a set, job recovery includes the digital display 70 indicating the number of the two sided copy sets in progress in the output receiving area.

Originals are then recirculated as follows. If the misfeed occurs during the last set copy cycle, the system recirculates the remaining documents of the set in progress without inverting them and returns them to the input tray. The system then recirculates and inverts the entire document set to make the even sides ready for copying. If a partial set is complete in the output receiving area, the RDH recircualtes and inverts additional documents corresponding to these copies (each two sided copy counts as one). The system resumes the job with the next even document and makes copies of the remaining even document in the set. The system than recirculates additional odd documents, originals, without inverting them, corresponding to the partially completed set, if any, in the output receiving area. The job is then resumed normally with the next odd document.

ALL OTHER DUPLEX TRAY MISFEED CONDITIONS

For the automatic feed for two sided documents for more than one two sided document in a set, the system recirculates and inverts the remaining documents of the set in progress for all other misfeed conditions. If a partial set is complete in the output receiving area, the system recirculates and inverts additional documents corresponding to these copies (each two sided copy counts as one). The system resumes the job with the next even document and makes copies of the remaining documents in the set. The system then recirculates additional odd documents corresponding to the partially completed set, if any, in the output receiving area and then resumes normally with the next odd document.

PROCESSOR PAPER JAM

For various paper jam detections, if the RDH is in use, the RDH completes any document change in process and then holds its position. The PROCESSOR immediately stops and the finisher including compiler 128 and stapler 181 or offset catch tray 126 completes processing normally any copies in the output paper path. The see instructions indicator illuminates in conjunction with the appropriate instruction code and the operator clears areas as indicated per the instructions.

In job recovery for the automatic feed of one sided documents/one sided copies, preferably, the digital display indicates the number of the set in progress in the output receiving area and preferably any copies not cleared from the processor paper path during jam clearance are delivered normally to the appropriate output receiving area as part of the job. If the document on the platen 100 does not correspond to the next copy required in the output receiving area, the system recirculates documents without exposing them until the correct document is on the platen and the system them resumes normal operation.

For the automatic feed of one sided documents/two sided copies and more than two documents in the set, if the jam occurs during the initial duplex tray priming cycle, the following sequence occurs. The digital display 70 reverts to the number being displayed at the time of the job interruption and the system recirculates documents without exposure until the document corresponding to the next copy required in the duplex tray 120 is on the platen and then the system resumes normally.

If the jam occurs during the last odd copy cycle of the job or for other jam conditions after all instruction codes have been cleared, the digital display indicates the number of the set in progress in the output receiving or finishing area 115. Preferably, copies left in the processor transport areas 117 and 118 after jam clearance are counted as completed copies in the output receiving area. Alternatively, the operator will be required to clear transport areas 117 and 118.

Job recovery is accomplished automatically when start print is pushed after the jam is cleared. Preferably, any copies in the processor not cleared during jam clearance are delivered normally to the appropriate recieving area as part of the job. If the jam clearance instructions did not require the operator to clear the duplex tray area, the system automatically cycles any copies in the duplex tray to the output receiving area. In systems having a finisher, these copies are cycled to the receiving areas not being used for the job. In systems without a finisher, preferably, these copies are cycled out on top of and offset from the set in progress in the output catch tray 126 but are not counted as part of the set.

JAM DURING ODD COPY CYCLE OF LAST SET

If the document on the platen 100 does not correspond to the next copy required in the output receiving area, the system recirculates documents without exposing them until the even document corresponding to the next one required in the output receiving area is on the platen. The system makes copies of the remaining even documents in the set to reprime the duplex tray 120. The system then recirculates documents without exposing them until the document corresponding to the next odd copy required in the output receiving area is on the platen. The system resumes the job normally from this point.

After all instruction codes have been cleared, the digital display 70 indicates the number of the set in progress in the output receiving area (preferably two sided copies left in the processor 117 and/or 118 transport areas after jam clearance are counted as completed copies in the output receiving areas). Job recovery is accomplished auto-matically when Start Print is pressed. Any copies in the processor paper path not cleared during jam clearance are delivered normally to the appropriate output receiving area as part of the job.

FOR ALL JAMS OTHER THAN LAST SET ODD CYCLE

If the jam clearance instrucitons did not require the operator to clear the duplex tray area, the system automatically cycles any copies in the duplex tray to the output receiving area. In "finisher" systems these are cycled to the receiving area not being used for the job. In non-finisher systems, preferably these copies are cycled out on top of and offset from the set in progress but are not counted as part of the set. If the document on the platen does not correspond to the next copy required in the output receiving area, the system recirculates documents without exposing them until the even document corresponding to the next one required in the output receiving area is on the platen. The system makes copies of a complete set of even documents starting from this point to reprime the duplex tray. The job is resumed normally with the next even document (if a partial set is in the output receiving area or original "N" (if there is not a partial set in the output receiving area).

For the automatic feed of two sided documents/two sided copies with more than one two sided document in a set, the following job recovery sequences are followed. After all instruction codes have been cleared, the digital display indicates the number of the set in progress in the output receiving area. Preferably the two sided copies left in the processor 117 and/or 118 transport area are conveyed to the appropriate output tray and counted as completed copies.

Job recovery is accomplished automatically when Start Print is pressed. Any copies in the processor paper path not cleared during jam clearance are delivered normally to the appropriate output receiving area as part of the job. If jam clearance instructions did not require the operator to clear the duplex tray, the system cycles any copies in the duplex tray to the output receiving area. In "finisher" systems these copies are cycled to the output receiving area not being used for the job. In "non-finisher" systems these copies are cycled out on top of the set in progress and preferably, offset, but are not counted as part of the set. The system recirculates documents without exposing them until the correct document is on the platen. Documents are recirculated as follows:

(1) If a purge of the duplex tray is required, and jam occurred during the last copy set cycle, the remaining documents of the partially completed set are recirculated without being inverted and stacked in the input tray.

(2) The system recirculates, inverts and stacks in the input tray the entire stack.

(3) The system recirculates, inverts, and stacks additional documents corresponding to copies of the partially completed set in the output receiving area (each two sided copy counts as one).

(4) The system resumes the job with the next even document and makes copies of the remaining even documents in the (5) The system then recirculates without inverting additional documents corresponding to copies of the partially completed set in the output receiving area (each two sided copy counts as one).

(6) The system resumes the job normally from this point.

If a purge of the duplex tray is required and more than one set is required, the remaining documents of the set in progress are recirculated, inverted and stacked in the input tray. If the odd side of the document set is ready to be exposed, the entire set is recirculated, inverted and stacked in the input tray. The system recirculates, inverts and stacks additional documents corresponding to copies of the partially complete set (if any) in the output receiving area (each two sided document counts as one). The system resumes the job with the next even document and makes copies of the remaining even documents in the set. The system then recirculates, inverts and stacks additional documents in the input tray corresponding to copies of the partially completed set, if any, in the output receiving area (each two sided copy counts as one). The system resumes the job normally from this point.

After all instruction codes have been cleared, the digital display 70 indicates the number of the set in progress in the output receiving area. Preferably, two sided copies left in the processor 117 and/or 118 transport area after jam clearance are conveyed to and counted as completed copies in the output receiving area. Job recovery is again accomplished automatically when start print is pushed. Preferably, any copies in the processor paper path not cleared during jam clearance are delivered normally to the appropriate receiving area as part of the job. If the document on the platen does not correspond to the next copy required in the duplex tray, the system recirculates documents without exposing them until the correct even document is on the platen. Preferably, copies destined for the duplex tray left in the processor 117 an/or 118 transport area after jam clearance are factored into this determination. Documents are recirculated as follows:

When no sheets fed from duplex tray were lost during jam clearance (1) Remaining even documents are recirculated, inverted and stacked in the input tray.

(2) Entire odd set is recirculated, inverted and stacked in the input tray.

(3) Additional even documents corresponding to any copies in the duplex tray are recirculated, inverted and stacked in the output tray.

The system resumes the job normally with the next even document.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. In a reproduction machine for producing duplex impressions of an original, the reproduction machine having a photosensitive member and a plurality of discrete operating components cooperable with one another and the photosensitive member to electrically produce the impressions on support material, the reproduction machine also including a first tray for feeding the support material and a second tray providing a buffer storage, and a finisher area having a plurality of receiving trays, a method of job recovery in a duplex operation in the event of a malfunction comprisng the steps of:

electronically indicating a machine malfunction;

determining the contents of the buffer storage;

selectively purging the buffer storage of all support material, to one of said receiving trays not in use;

repriming the buffer storage, and automatically resuming operation after the buffer storage has been purged.

2. In a reproduction machine for producing copies of an original, the reproduction machine having a photosensitive member a finshed copy area having first and second stations, the first of said first and second stations being designated to receive finished copies, and a plurality of discrete operating components including a duplex buffer storage cooperable with one another and the photosensitive member to electrically produce the copies, the copies of the originals being in various stages of completion in the reproduction machine, a method of job recovery in response to machine conditions comprising the steps of:

electronically indicating a machine condition, determining the type of machine condition, purging selected copies from the duplex buffer storage to the second station and repriming the duplex buffer storage.

3. In a reproduction machine for producing images of an original, the combination of a photosensitive member, a finishing area having first and second copy receiving stations, and a plurality of discrete operating components cooperable with one another and the photosensitive member to electrically produce the images on copy sheets, a first tray for feeding the copy sheets, a second tray providing a buffer storage for use in duplex operation and job recovery means comprising:

means for electronically indicating a machine condition, means for determining the type of condition, and means responsive to certain types of conditions for purging the second tray of copies to a selected one of the copy receiving stations and for providing selected copies to the buffer storage, the selected copies being copies with images on one side.

* * * * *